US007468719B2

(12) United States Patent
Kawachi

(10) Patent No.: US 7,468,719 B2
(45) Date of Patent: Dec. 23, 2008

(54) LIQUID CRYSTAL PIXEL MEMORY, LIQUID CRYSTAL DISPLAY, AND METHODS OF DRIVING THE SAME

(75) Inventor: Genshiro Kawachi, Yokohama (JP)

(73) Assignee: Advanced LCD Technologies Development Center Co., Ltd., Yokohama (JP)

( * ) Notice: Subject to any disclaimer, the term of this patent is extended or adjusted under 35 U.S.C. 154(b) by 567 days.

(21) Appl. No.: 11/044,350

(22) Filed: Jan. 28, 2005

(65) Prior Publication Data

US 2005/0174313 A1 Aug. 11, 2005

(30) Foreign Application Priority Data

Feb. 9, 2004 (JP) ..... 2004-032440

(51) Int. Cl.
*G09G 3/36* (2006.01)

(52) U.S. Cl. ..... 345/98; 345/55; 345/204; 345/205

(58) Field of Classification Search ..... 345/98, 345/55, 204–205
See application file for complete search history.

(56) References Cited

U.S. PATENT DOCUMENTS 4,259,600 A * 3/1981 Fellrath et al. ..... 327/109

FOREIGN PATENT DOCUMENTS

| | | | |
|---|---|---|---|
| JP | 7-36058 | | 2/1995 |
| JP | 9-258168 | | 10/1997 |
| JP | 9-274200 | | 10/1997 |
| JP | 2003-15155 | | 1/2003 |
| JP | 2003-149664 | * | 5/2003 |

* cited by examiner

*Primary Examiner*—Richard Hjerpe
*Assistant Examiner*—Leonid Shapiro
(74) *Attorney, Agent, or Firm*—Oblon, Spivak, McClelland, Maier & Neustadt, P.C.

(57) ABSTRACT

A liquid crystal display includes a pair of support substrates, a liquid crystal layer held between the substrates, and pixel circuits that are arrayed in a matrix on one of the substrates and control the alignment state of liquid crystal molecules. Each pixel circuit includes first and second power terminals, first and second pixel electrodes that apply a liquid crystal drive voltage to the liquid crystal layer to create a substantially lateral electric field, and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes.

15 Claims, 16 Drawing Sheets

LIQUID CRYSTAL PIXEL MEMORY, LIQUID CRYSTAL DISPLAY, AND METHODS OF DRIVING THE SAME

CROSS-REFERENCE TO RELATED APPLICATIONS

This application is based upon and claims the benefit of priority from prior Japanese Patent Application No. 2004-032440, filed Feb. 9, 2004, the entire contents of which are incorporated herein by reference.

BACKGROUND OF THE INVENTION

1. Field of the Invention

The present invention relates to a liquid crystal pixel memory, a liquid crystal display, and methods of driving the liquid crystal pixel memory and the liquid crystal display, wherein a liquid crystal drive voltage, the polarity of which is cyclically reversed in order to control the alignment state of liquid crystal molecules, is applied to a liquid crystal layer.

2. Description of the Related Art

An active matrix liquid crystal display, for example, is used in OA apparatuses or other various apparatuses as a display device for displaying information such as characters and graphics. This liquid crystal display is a display panel that has, in usual cases, such a structure that a liquid crystal layer is held between a pair of substrates. In this display panel, a plurality of pixels are arrayed in a matrix, thereby forming a display screen. Each pixel is driven via a thin film transistor (TFT).

In a conventional active matrix liquid crystal display, a plurality of pixels are driven by, in usual cases, a line-at-a-time driving method. In the line-at-a-time driving method, a plurality of pixels are successively selected in units of rows that form a single horizontal line. A video signal for one horizontal line is supplied to the pixels of the selected row (right-and-left direction). Each pixel has a pixel capacitance that is charged and discharged by the associated video signal. This pixel capacitance includes a liquid crystal capacitance, which is obtained between a pair of electrodes that apply a voltage of the video signal to the liquid crystal layer as a liquid crystal drive voltage, and a storage capacitance that is connected in parallel to this liquid crystal capacitance. The alignment state of liquid crystal molecules is controlled by an electric field that is created between the pair of electrodes in accordance with the liquid crystal drive voltage. The polarity of the liquid crystal drive voltage is changed in cycles of one frame period, which is a refresh period of the video signal.

If the alignment state of liquid crystal molecules is continuously controlled by a unidirectional electric field, non-uniform distribution of liquid crystal molecules occurs in the liquid crystal layer. The non-uniform distribution makes the liquid crystal display inoperable, so the polarity of the liquid crystal drive voltage needs to be reversed in cycles of, e.g. one frame period. Further, in a case where dot-reversal driving is executed in order to suppress flicker, the alignment state of liquid crystal molecules is controlled by the liquid crystal drive voltages whose polarities are opposite between adjacent pixels. In this case, a video signal for one horizontal line is supplied to the pixels of the selected row via signal lines, with the polarity of the video signal being reversed in cycles of each horizontal scan period. Specifically, a signal line driver LSI drives video signal lines in accordance with the video signal for one horizontal line. Since a parasitic wiring capacitance on the signal lines is charged and discharged with the polarity that is reversed by the driver LSI in cycles of one horizontal scan period, the power consumption of the driver LSI is very large. The power consumption P of the driver LSI is approximately given by $$P=C_L \cdot f_F \cdot N_S \cdot V_{SIG}^2$$

where $C_L$ is the total wiring capacitance of the signal lines, $f_F$ is the frame frequency, $N_S$ is the number of scan lines, and $V_{SIG}$ is a maximum amplitude (Peak-to-Peak value) of the video signal. If the size and definition of the display panel of the liquid crystal display are increased, both the wiring capacitance for the video signal and the frame frequency will increase. It is thus understood that the power consumption of the signal line driver LSI will rise at an increasing rate. As a measure to solve this problem, first prior art is proposed (see, e.g. Jpn. Pat. Appln. KOKAI Publication No. 9-258168 and Jpn. Pat. Appln. KOKAI Publication No. 9-274200). According to the first prior art, a memory element with, e.g. an SRAM structure is provided in the pixel circuit, and the video signal is thinned out on a frame-by-frame basis. Thereby, an increase in power consumption is suppressed.

Further, in the active matrix liquid crystal display, how to enhance the image quality is also a technical problem to be solved. As regards this problem, a liquid crystal display with a lateral electric field driving mode is proposed as second prior art (see, e.g. Jpn. Pat. Appln. KOKAI Publication No. 07-036058, Jpn. Pat. Appln. KOKAI Publication No. 2003-149664 and Jpn. Pat. Appln. KOKAI Publication No. 2003-15155). In the liquid crystal display of a lateral electric field driving mode, a pair of pixel electrodes are provided in each of the pixel areas of one of the substrates, and a lateral electric field, which is substantially parallel to the plane of the electrode, that is, the surface of the substrate, is created in the liquid crystal layer by these pixel electrodes. Thereby, liquid crystal molecules are rotated in the plane to effect a multi-gradation display. Hence, a high contrast ratio and high color reproducibility can be realized within a wider field of view.

In the first prior art, the memory elements in the pixel circuits are digital memories. Thus, in order to perform ordinary gradation display, it is necessary to provide memory elements in number corresponding to the number of gradations for display, and signal lines for supplying signals to the memory elements. For example, in order to enable a display in 64 gradations, it is necessary to arrange memory elements for six bits, as well as six signal lines, within the pixel area of each of all the pixels. If such a number of elements and lines are actually provided within the limited pixel area, the aperture ratio and manufacturing yield will deteriorate. Thus, it is difficult to provide a low-power-consumption, high-image-quality liquid crystal display at low cost.

In the second prior art, the image quality of the liquid crystal display can be enhanced, but no consideration is given to the problem of power consumption of the signal line driver LSI. Each pixel is configured such that a video signal coming from a signal line driven by the driver LSI is sampled by a sampling transistor and is directly applied to the liquid crystal layer as a liquid crystal drive voltage. In this configuration, an increase in power consumption of the signal line driver LSI cannot be suppressed.

BRIEF SUMMARY OF THE INVENTION

The present invention has been made in order to solve the above-described problems, and the object of the invention is to provide a liquid crystal pixel memory, a liquid crystal display, and methods of driving the same, wherein a high image quality can be obtained without an increase in power consumption.

According to a first aspect of the present invention, there is provided a liquid crystal pixel memory comprising: first and second power terminals; first and second pixel electrodes that apply a liquid crystal drive voltage to a liquid crystal layer to create a substantially lateral electric field in the liquid crystal layer; and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes.

According to a second aspect of the present invention, there is provided a method of driving a liquid crystal pixel memory including first and second power terminals; first and second pixel electrodes that apply a liquid crystal drive voltage to a liquid crystal layer to create a substantially lateral electric field in the liquid crystal layer; and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, the method comprising: controlling the conductances of the first and second drive transistors by supplying the video signal to the gate electrodes of the first and second transistors; and changing the voltages applied to the first and second power terminals such that the polarity of the liquid crystal drive voltage determined by the conductances is cyclically reversed.

According to a third aspect of the present invention, there is provided a liquid crystal display comprising: a pair of support substrates; a liquid crystal layer that is held between the pair of support substrates; and a plurality of pixel circuits that are arrayed in a matrix on one of the support substrates and control the alignment state of liquid crystal molecules, wherein each of the pixel circuits includes: first and second power terminals; first and second pixel electrodes that apply a liquid crystal drive voltage to the liquid crystal layer to create a substantially lateral electric field in the liquid crystal layer; and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes.

According to a fourth aspect of the present invention, there is provided a liquid crystal display comprising: a pair of support substrates; a liquid crystal layer that is held between the pair of support substrates; and a plurality of pixel circuits that are arrayed in a matrix on one of the support substrates and control the alignment state of liquid crystal molecules, wherein each of the pixel circuits includes first and second power terminals, first and second pixel electrodes that apply a liquid crystal drive voltage to the liquid crystal layer to create a substantially lateral electric field in the liquid crystal layer, and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, wherein one of the support substrates includes a plurality of first address lines arranged along rows of the pixel circuits, a plurality of second address lines arranged along columns of the pixel circuits and a plurality of video signal lines arranged along columns of the pixel circuits, and wherein each of the pixel circuits is disposed in one of pixel areas defined by the first address lines and the second address lines, and includes a logic gate circuit that generates an output signal in response to select signals from both of a pair of the first and second address lines, and a sampling transistor that has a gate electrode connected to receive the output signal and is connected between an associated one of the video signal lines and the gate electrodes of the first and second drive transistors.

According to a fifth aspect of the present invention, there is provided a method of driving a liquid crystal display which includes a pair of support substrates, a liquid crystal layer that is held between the pair of support substrates, and a plurality of pixel circuits that are arrayed in a matrix on one of the support substrates and control the alignment state of liquid crystal molecules, wherein each of the pixel circuits includes first and second power terminals, first and second pixel electrodes that apply a liquid crystal drive voltage to the liquid crystal layer to create a substantially lateral electric field in the liquid crystal layer, and first and second drive transistors that have gate electrodes for receiving a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, the method comprising: controlling the conductances of the first and second drive transistors by supplying the video signal to the gate electrodes of the first and second transistors; and changing the voltages applied to the first and second power terminals such that the polarity of the liquid crystal drive voltage determined by the conductances, is cyclically reversed.

The present invention can provide a liquid crystal pixel memory, a liquid crystal display, and methods of driving the same, wherein a high image quality can be obtained without an increase in power consumption.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
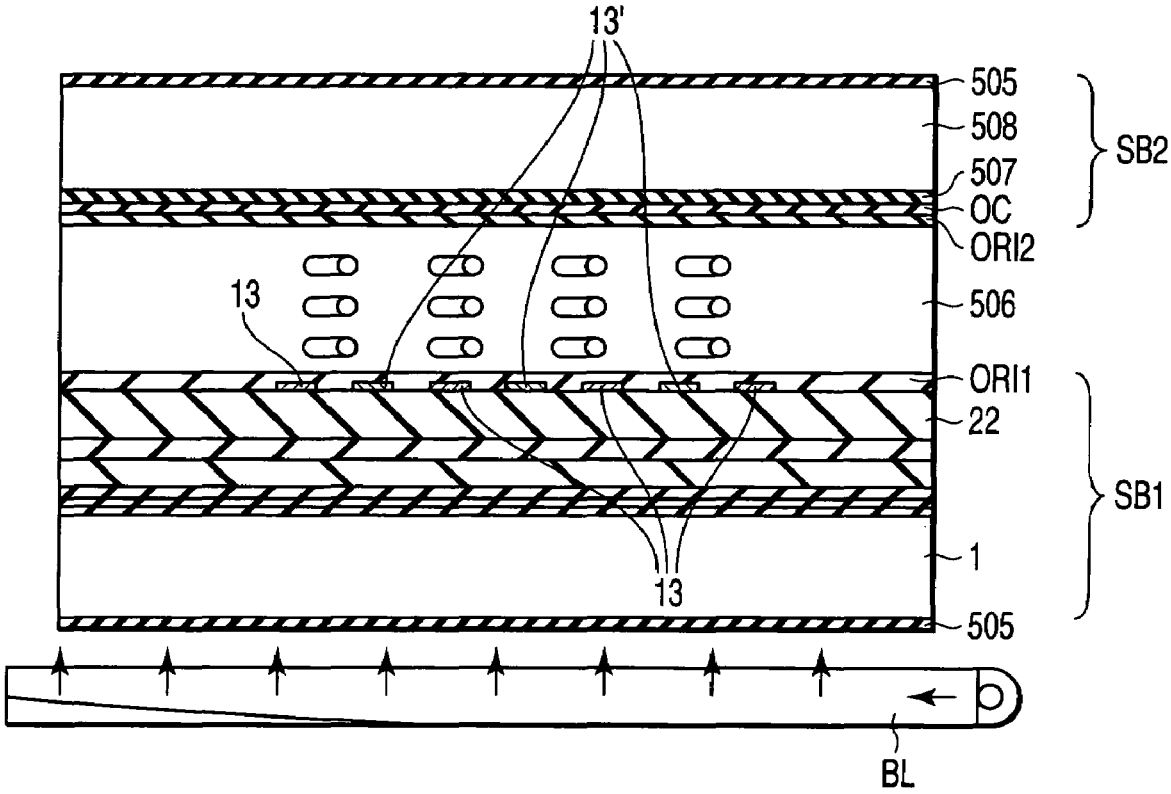
FIG. 1 shows the cross-sectional structure of a transmission-type active matrix liquid crystal display according to a first embodiment of the present invention.

The above-mentioned liquid crystal pixel memory, liquid crystal display and methods of driving the same are common with respect to the following technical matters. A video signal is supplied to gate electrodes of first and second drive transistors. A liquid crystal drive voltage is equal to a voltage that is applied to a capacitance between first and second pixel electrodes from first and second power terminals via the first and second drive transistors. Specifically, the drains of the first and second drive transistors are connected to the first and second power terminals, and the liquid crystal capacitance is connected between the source of the first drive transistor and the source of the second drive transistor. In other words, the first and second drive transistors have such a circuit configuration that two source follower circuits having the liquid crystal capacitance as a common load are connected in series. Thus, the liquid crystal drive voltage is set by the conductances of the first and second drive transistors. The polarity of the liquid crystal drive voltage can cyclically be reversed by changing the relationship in potential between the first and second power terminals. Specifically, AC voltages, each of which has a rectangular waveform with a level shift between, e.g. 5 V (high level) and 0 V (low level), may be applied to the first and second power terminals with a complementary phase relationship.

If a video signal voltage Vs that does not exceed a maximum (high level) value of an AC voltage is applied to the gate electrodes of the first and second drive transistors, the drive transistor, which is provided on the side of the power terminal that is shifted to the high level potential, outputs a source potential that is set at Vs−Vt. Symbol Vt indicates the threshold voltage of this drive transistor. On the other hand, the drive transistor, which is provided on the side of the power terminal that is shifted to the low level potential, outputs a low-level source potential, i.e. a source potential of 0 V. Accordingly, a voltage drop in the liquid crystal capacitance is Vs−Vt.

Subsequently, if the relationship in potential between the first and second power terminals is reversed, a voltage drop in the liquid crystal capacitance becomes−(Vs−Vt).

By repeatedly reversing the relationship in potential between the first and second power terminals at proper cycles, the polarity of the liquid crystal drive voltage that is retained in the liquid crystal capacitance between the first and second pixel electrodes can be reversed. In this case, refreshing of the video signal, which is supplied to the gate electrodes of the first and second drive transistors, is not needed in order to reverse the polarity of the liquid crystal drive voltage. In other words, if the liquid crystal voltage that is proportional to the video signal voltage Vs is retained in the liquid crystal capacitance between the first and second pixel electrodes, the polarity of the liquid crystal drive voltage can be reversed automatically. As a result, it becomes possible to reduce the refreshing frequency, i.e. the video refresh rate, with which a video signal processing circuit such as a signal line driver LSI refreshes the video signal for one frame, and to reduce the power consumption in this video signal processing circuit. Moreover, since the video signal voltage itself is not used as the liquid crystal drive voltage that requires cyclic polarity reversal, it is possible to supply, as a video signal, a unipolar analog voltage having a maximum amplitude that is half the maximum amplitude in the prior art. Thereby, the power that is consumed to drive the signal line in accordance with the video signal voltage can be reduced. Furthermore, since the structure of the video signal circuit can be simplified, the manufacturing cost of the driver LSI can be reduced.

First Embodiment

A transmission-type active matrix liquid crystal display according to a first embodiment of the present invention will now be described with reference to the accompanying drawings.

Figure 2:
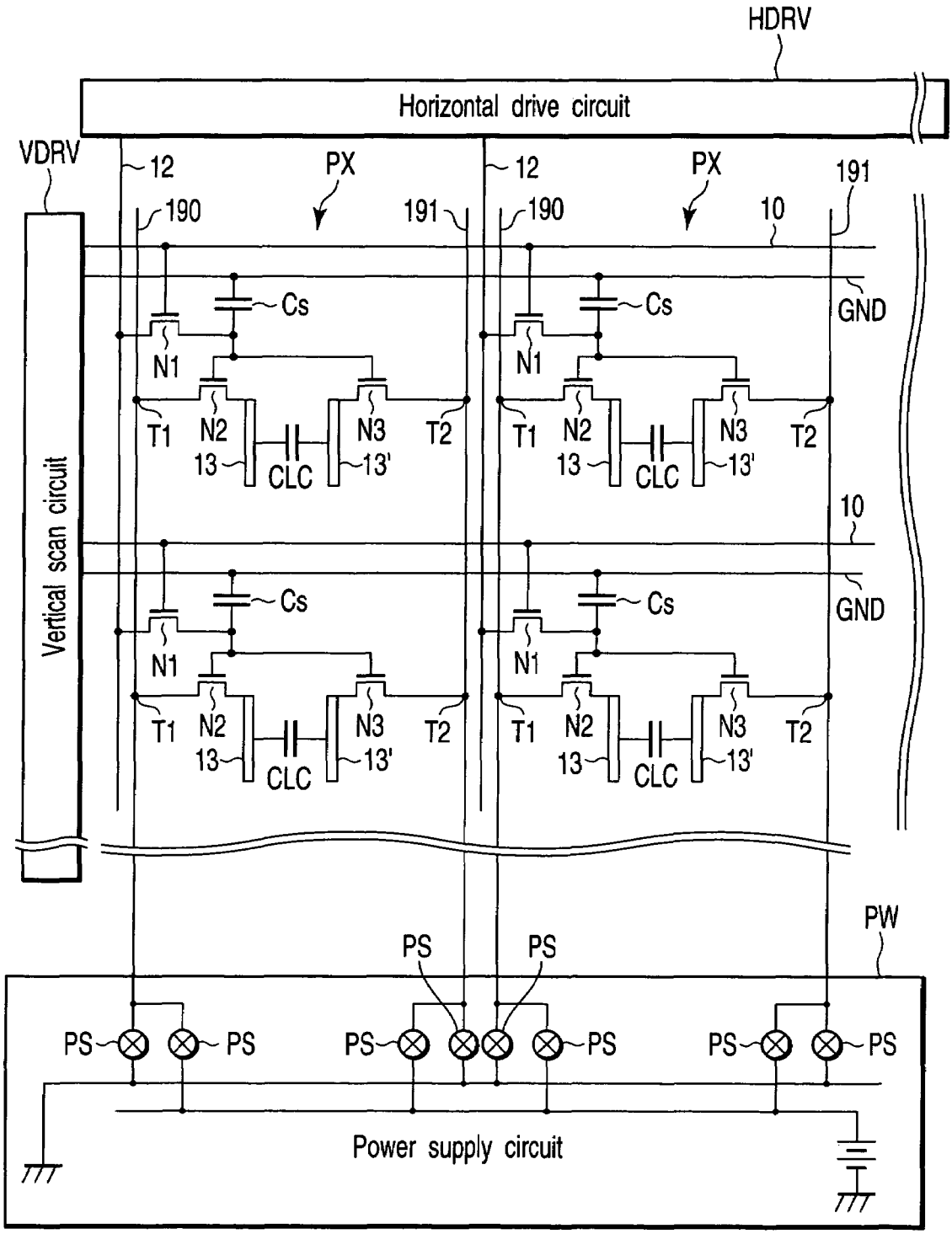
FIG. 2 schematically shows the plan-view structure of the liquid crystal display shown in FIG. 1.
Figure 3:
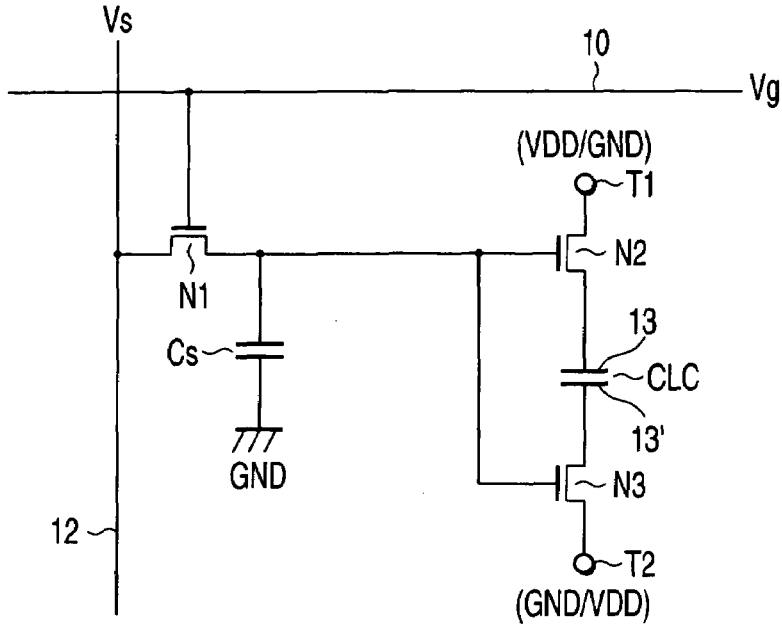
FIG. 3 shows an equivalent circuit of one of the pixel circuits that are arrayed in a matrix in the liquid crystal display shown in FIG. 2.

FIG. 1 shows the cross-sectional structure of the transmission-type active matrix liquid crystal display. FIG. 2 schematically shows the plan-view structure of this liquid crystal display. FIG. 3 shows an equivalent circuit of one of the pixel circuits PX that are arrayed in a matrix in the liquid crystal display shown in FIG. 2.

The liquid crystal display is configured such that a liquid crystal layer 506, for example, is held between a pair of support substrates SB1 and SB2, as shown in FIG. 1. The support substrate SB1 is formed by stacking a protection insulation film 22, etc. on a glass substrate 1. As shown in FIG. 2, the support substrate SB1 includes a plurality of pixel circuits PX arrayed in a matrix; a plurality of scan lines 10 arranged along the rows of pixel circuits PX; a plurality of video signal lines 12 arranged along columns of the pixel circuits PX; a vertical scan circuit VDRV that drives the scan lines 10; and a horizontal drive circuit HDRV that drives the video signal lines 12. The pixel circuits PX are respectively arranged in pixel areas, which are defined by the scan lines 10 and video signal lines 12. In these pixel areas, the pixel circuits PX control the alignment state of liquid crystal molecules. The support substrate SB2 is formed by stacking a color filter 507, a color filter protection film OC, etc. on a glass substrate 508. The support substrates SB1 and SB2 include a lower alignment film ORI1 and an upper alignment film ORI2, respectively, which are formed adjacent to the liquid crystal layer 506 so as to determine the alignment directions of liquid crystal molecules.

The support substrates SB1 and SB2 are independently fabricated, and then the support substrates SB1 and SB2 are bonded by a sealing member (not shown) that is added to outer peripheral parts thereof. The liquid crystal layer 506 is obtained by injecting and sealing a liquid crystal composition in the space defined by the sealing member between the support substrates SB1 and SB2.

A pair of polarizer plates 505 are attached to those exposed surfaces of the glass substrates 1 and 508, which are opposed to the alignment films ORI1 and ORI2. The polarized-light transmission axes of the polarizer plates 505 are set in a cross-Nicol. A backlight BL is disposed adjacent to the polarizer plate 505 that is attached to the surface of the glass substrate 1. Light from the backlight BL is optically modulated by the liquid crystal layer 506 under the control of each pixel circuit.

Each pixel circuit PX includes first and second power terminals T1 and T2, first and second pixel electrodes 13 and 13', a sampling transistor N1, first and second drive transistors N2 and N3, and a storage capacitance Cs. As regards the symbols attached to reference numerals, an n-channel transistor is indicated by "N", and a p-channel transistor is indicated by "P". The first and second pixel electrodes 13 and 13' apply a liquid crystal drive voltage to the liquid crystal layer 506, thereby creating a lateral electric field in the liquid crystal layer. The first drive transistor N2 includes a gate electrode that receives a video signal, and a current path connected between the first power terminal T1 and the first pixel electrode 13. The current path refers to a conductive state of the transistor in which a current corresponding to the voltage applied to the gate electrode flows. The second drive transistor N3 includes a gate electrode that receives the video signal, and a current path connected between the second power terminal T2 and the second pixel electrode 13'. The drive transistors N2 and N3 cause a liquid crystal drive voltage VLC determined by the conductances that vary in accordance with the video signal, to be retained in a liquid crystal capacitance CLC between the first and second pixel electrodes 13 and 13'. To be more specific, each of the transistors N1 to N3 comprises an N-channel thin film transistor (TFT). The first pixel electrode 13 is connected to the source of the first drive transistor N2, and the second pixel electrode 13' is connected to the source of the second drive transistor N3. The gate electrode of the sampling transistor N1 is connected to the associated scan line 10. The drain of the sampling transistor N1 is connected to the associated video signal line 12, and the source of the sampling transistor N1 is connected to the gate electrodes of the first and second drive transistors N2 and N3. A storage capacitance Cs is connected between the source of the sampling transistor N1 and a common electrode line GND.

On the support substrate SB1, pairs of first and second power lines 190 and 191 are disposed along the columns of pixel circuits PX. The first and second power terminals T1 and T2 of each pixel circuit PX are electrical branch points provided on the paired first and second power lines 190 and 191. The power lines 190 and 191 are connected to a power supply circuit PW, and are set at one and the other of a high-level potential (VDD: e.g. 5 V) and a ground potential (GND: e.g. 0 V). The power supply circuit PW includes a plurality of switches PS that are driven so as to reverse the relationship in potential, e.g. the polarity of voltage, between the power line 190 and power line 191 at predetermined cycles of, e.g. one frame, thereby to prevent a non-uniform distribution of liquid crystal molecules.

Each of the vertical scan circuit VDRV and horizontal drive circuit HDRV is formed as driver LSI units. The vertical scan circuit VDRV generates a select pulse that selects a row of a number of arrayed pixel circuits PX and is supplied to one of the scan lines 10. The horizontal drive circuit HDRV supplies a video signal for one horizontal line to the video signal lines 12 while the select pulse is supplied. The pixel circuits PX of the selected row receive the video signal from the associated video signal lines 12. Specifically, the sampling transistor N1 is rendered conductive by a voltage Vg of the select pulse, and outputs a voltage Vs of the video signal to the gate electrodes of the drive transistors N2 and N3 via the storage capacitance Cs. The voltage Vs of the video signal is sampled when the sampling transistor N1 is rendered nonconductive, and is held in the storage capacitance Cs as gate voltages to the drive transistors N2 and N3. The drive transistors N2 and N3 cause a liquid crystal drive voltage VLC to be retained in the liquid crystal capacitance CLC between the first and second pixel electrodes 13 and 13' by the conductances that vary in accordance with the video signal. The liquid crystal drive voltage VLC takes a value corresponding to the video signal voltage Vs within the range of the potential difference between the power lines 190 and 191.

Figure 4:
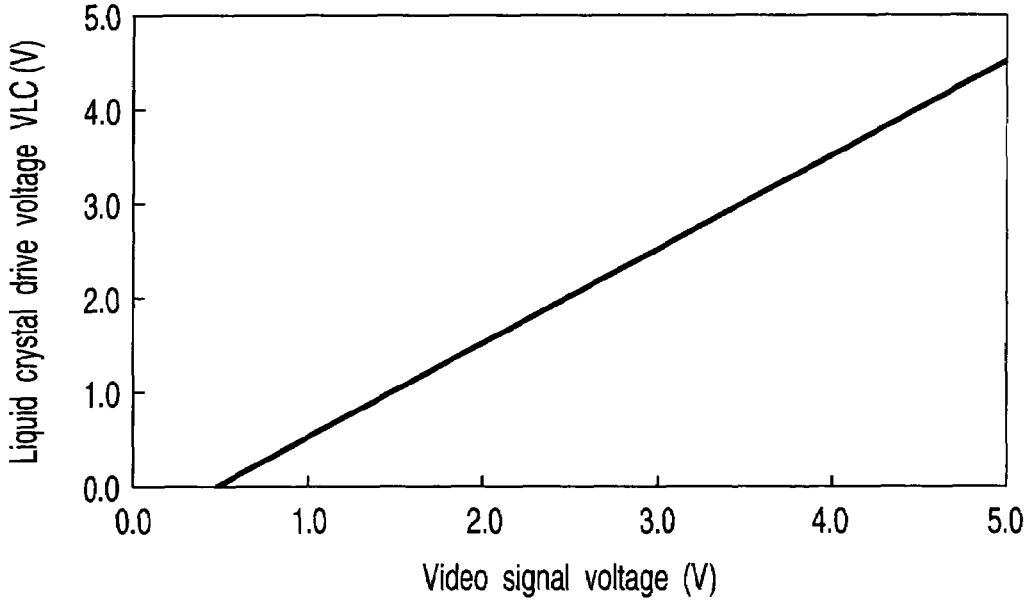
FIG. 4 is a graph showing the voltage input/output characteristic of the pixel circuit shown in FIG. 3.

FIG. 4 shows the voltage input/output characteristic of the pixel circuit PX shown in FIG. 3. The abscissa indicates the value of the video signal voltage Vs that is input from the video signal line 12, and the ordinate indicates the value of the liquid crystal drive voltage VLC that is output to the liquid crystal capacitance CLC between the pixel electrodes 13 and 13'. The potential difference between the power lines 190 and 191 is set to be equal to the maximum value of the video signal voltage Vs. As is understood from FIG. 4, the liquid crystal drive voltage VLC, in fact, becomes lower than the video signal voltage Vs by a degree corresponding to the threshold voltage Vt of the drive transistor N2, N3. The liquid crystal drive voltage VLC is 0 V, relative to the video signal voltage Vs that is less than the threshold voltage Vt.

For example, if the video signal voltage Vs of 4 V is applied as gate voltages to the drive transistors N2 and N3 in the state in which the potential of the power line 190 is at a high level of 5 V and the potential of the power line 191 is at a low level of 0 V, the potential of the pixel electrode 13' is set at (4−Vt) V and the potential of the pixel electrode 13 is set at 0 V. The liquid crystal drive voltage VLC is set at (4−Vt) V that is the potential difference between the pixel electrodes 13 and 13'. In this case, Vt is the threshold voltage of one drive transistor N3.

On the other hand, if the video signal voltage Vs of 4 V is applied as a gate voltage to the drive transistors N2 and N3 in the state in which the potential of the second power line 191 is at a high level of 5 V and the potential of the first power line 190 is at a low level of 0 V, the potential polarities of the first pixel electrode 13 and second pixel electrode 13' are reversed and the direction of the electric field created between the pixel electrodes 13 and 13' is reversed. In order to cyclically reverse the polarity of the liquid crystal drive voltage VLC and to prevent non-uniform distribution of liquid crystal molecules, the relationship in potential between the power lines 190 and 191, that is, the power terminals T1 and T2, may be changed in the above-described manner.

Figure 5:
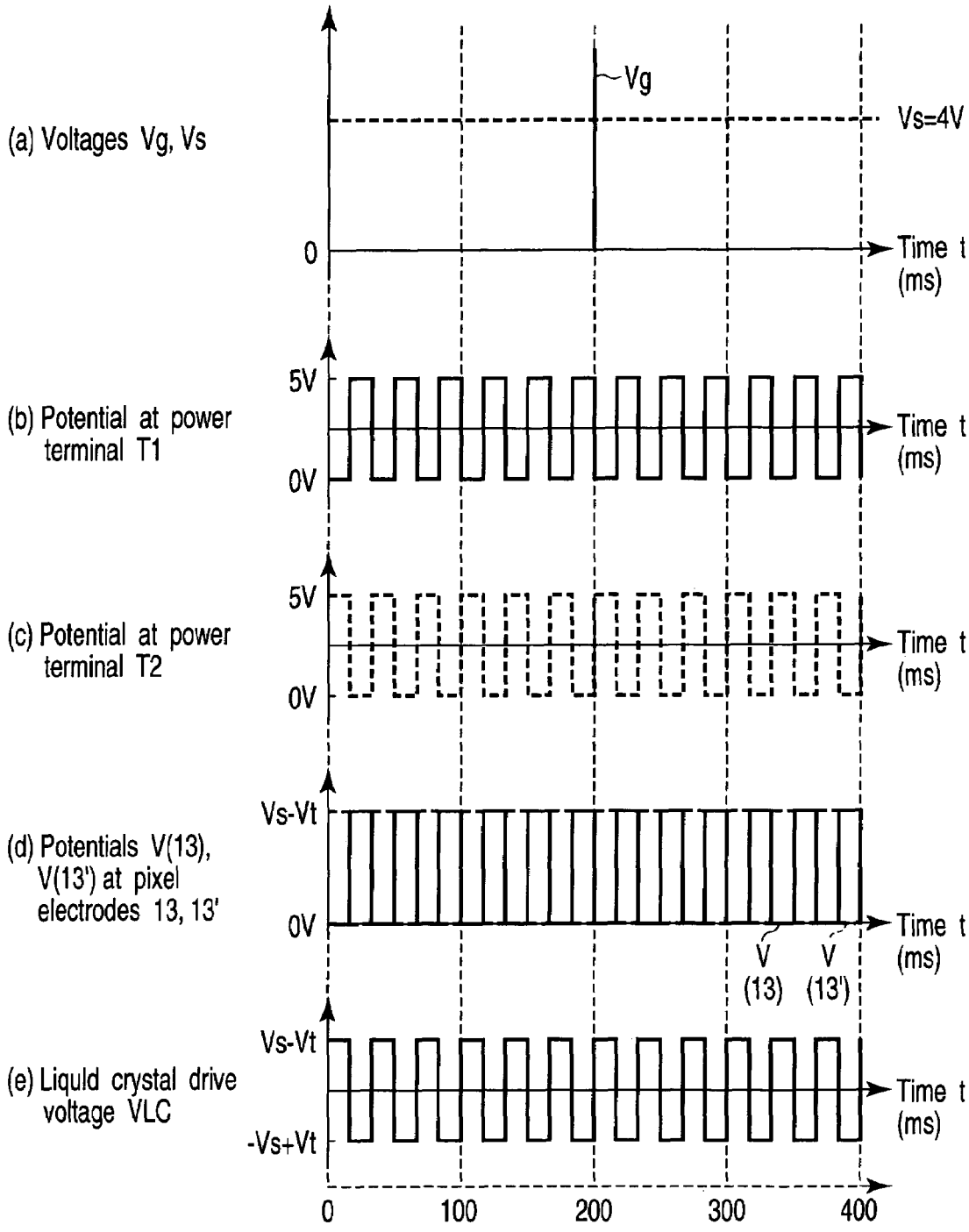
FIG. 5 is a timing chart for explaining the operation of the pixel circuit shown in FIG. 3.

FIG. 5 is a time chart for explaining the operation of the pixel circuit PX shown in FIG. 3. The select pulse voltage Vg and video signal voltage Vs are applied to the scan line 10 and video signal line 12, as shown in part (a) of FIG. 5. For easier understanding, the video signal voltage Vs is fixed at a constant value of 4 V. In general cases, however, the video signal voltage Vs is shaped to have a temporally varying waveform in order to obtain a liquid crystal drive voltage VLC that varies from pixel to pixel. The cycle of the select pulse voltage Vg is set at 200 ms. In conventional liquid crystal displays, this cycle is generally set at 16.7 ms.

A voltage with a waveform indicated by a solid line in part (b) of FIG. 5 and a voltage with a waveform indicated by a broken line in part (c) of FIG. 5 are applied to the power lines 190 and 191. These voltages have rectangular waveforms with a phase difference of 180°, and the cycle thereof is, e.g. 33.4 ms.

If the voltages with the waveforms shown in parts (b) and (c) of FIG. 5 are applied to the power lines 190 and 191, voltage waveforms shown in part (d) of FIG. 5 are obtained at the pixel electrodes 13 and 13'. These waveforms, like the voltage waveforms shown in parts (b) and (c) of FIG. 5, are rectangular waveforms with a cycle of 33.4 ms and a phase difference of 180°. The peak values of the voltage waveforms are (4−Vt) V on the high level side and 0 V on the low level side.

The potential difference between the pixel electrodes 13 and 13', that is, the liquid crystal drive voltage VLC, has a waveform as shown in part (e) in FIG. 5, and this voltage is actually applied to the liquid crystal layer 506 by the pixel electrodes 13 and 13'. The effective value of the liquid crystal drive voltage VLC is (4−Vt) V, and the cycle thereof is 33.4 ms.

In the present embodiment, the video signal voltage Vs is sampled by the sampling transistor N1, and then the video signal voltage Vs is held by the storage capacitance Cs. The video signal voltage Vs is continuously applied, as a gate voltage, to each of the driver transistors N2 and N3. Hence, in the pixel circuit Px, the relationship in potential between the power lines 190 and 191 is reversed with a desired cycle, and a fixed liquid crystal voltage VLC, whose polarity is reversed with this cycle, can continuously be applied to the liquid crystal layer 506. In other words, the polarity of the liquid crystal drive voltage VLC can be reversed regardless of the polarity of the video signal voltage Vs, thus a normal display operation can be continued without a non-uniform distribution of liquid crystal molecules. In the prior art, for example, during the time period of still image display, there is no need to vary the video signal voltage Vs. Nevertheless, it is necessary to reverse the polarity of the liquid crystal drive voltage VLC by reversing the polarity of the video signal voltage Vs with a cycle corresponding to, e.g. one frame period of the video signal. However, in the present embodiment, the polarity of the liquid crystal drive voltage VLC is reversed with a liquid crystal refresh cycle that is longer than the 1-frame period of the video signal, whereby the drive operations of the vertical scan circuit VDRV and horizontal drive circuit HDRV can be suspended. Therefore, the power consumption of the driver LSI can greatly be reduced.

In addition, it should suffice if the driver LSI of the horizontal drive circuit HDRV merely outputs a unipolar video signal voltage Vs to each video signal line 12. Thus, the maximum value thereof is substantially restricted only by the maximum output voltage of the power supply circuit PW. In this case, unlike the prior art, there is no need to configure the driver LSI of the horizontal drive circuit HDRV so as to be able to output both positive and negative analog voltages. Hence, the driver LSI can be manufactured by an ordinary low-withstand-voltage CMOS process to reduce the manufacturing cost thereof. Further, the decreased amplitude by virtue of the unipolar video signal voltage Vs contributes toward reducing the power consumption of the driver LSI and also reducing a crosstalk voltage caused by a parasitic capacitance present between the video signal line 12 and the pixel electrode 13, 13'. In this case, vertical shadowing of an image, which is generally called "vertical smear," is reduced. Thus, an enhancement in image quality is expectable.

In the above example, the cycle of the select pulse that is supplied to the scan line 10 is stated as 200 ms. Alternatively, this cycle may be set at a value greater than 200 ms, or set at 16.7 ms as in the prior art, if it falls within such a range that the potential can be retained by the storage capacitance Cs.

Figure 6:
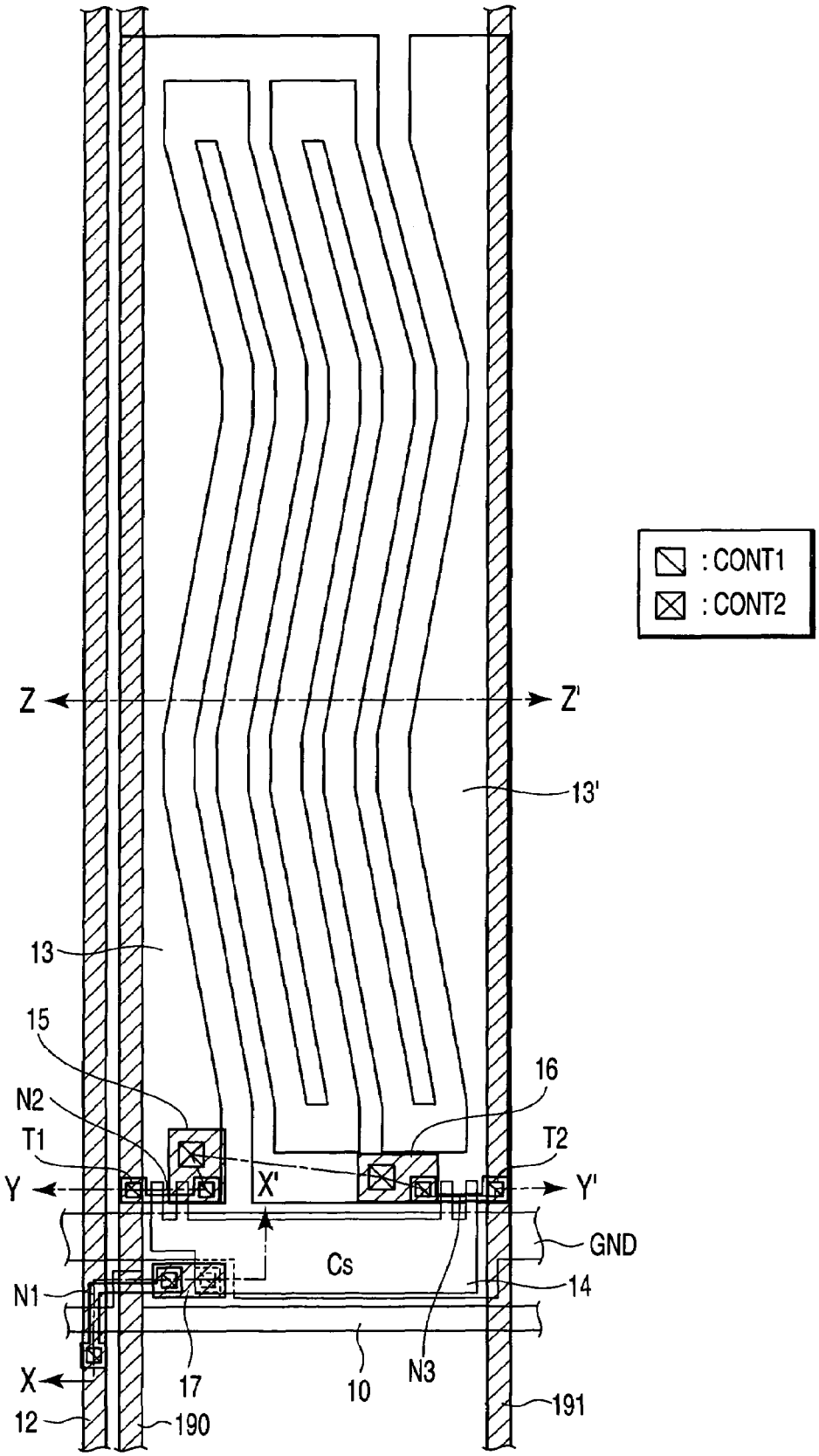
FIG. 6 shows the plan-view structure of the pixel circuit shown in FIG. 3.

FIG. 6 shows the plan-view structure of the pixel circuit PX shown in FIG. 3. The pixel circuit PX is disposed in a pixel area that is defined between two adjacent scan lines 10 in the vertical direction corresponding to the column direction, and between two adjacent video signal lines 12 and first and second power lines 190 and 191 in the horizontal direction corresponding to the row direction. The pixel area has a pitch of, e.g. 74 μm in the horizontal direction and a pitch of, e.g. 222 μm in the vertical direction. The pixel electrodes 13 and 13', sampling transistor N1, drive transistors N2 and N3 and storage capacitance Cs are laid out in the pixel area, as shown in FIG. 6. The drain and source of the sampling transistor N1 are connected to the video signal line 12 and a connection electrode 17 via a pair of contact through-holes CONT1. The connection electrode 17 is connected via a contact through-hole CONT1 to a connection electrode 14 that also serves as a gate electrode of the driver transistor N2, N3.

The drain and source of the drive transistor N2 are connected to the power terminal T1, which is a part of the power line 190, and to a connection electrode 15 via a pair of contact through-holes CONT1. The drain and source of the drive transistor N3 are connected to the power terminal T2, which is a part of the power line 191, and to a connection electrode 16. The pixel electrodes 13 and 13' are connected to the connection electrodes 15 and 16 via a pair of contact through-holes CONT2. The storage capacitance Cs is formed by capacitive coupling between the connection electrode 14, which is provided between the gate electrodes of the drive transistors N2 and N3, and the common electrode line GND. The storage capacitance Cs has sufficient capacitance to retain a gate voltage for a predetermined time period. In order to suppress leak current, the sampling transistor N1 is formed as a double-gate nmOS transistor with a channel width of 1.5 μm and a channel length of 3 μm+3 μm, and the drive transistor N2, N3 is formed as a double-gate nmOS transistor with a channel width of 1.5 μm and a channel length of 1.5 μm+1.5 μm. The pixel electrodes 13 and 13' are formed of transparent electrodes of, e.g. ITO, which have intermeshing comb-shaped plan-view patterns that are bent, as shown in FIG. 6. The width of each comb tooth of the pixel electrode 13, 13' is set at 3 μm. The gap between the pixel electrodes 13 and 13', that is, the distance between adjacent two teeth, is set at 7 μm.

The bending of each tooth can prevent a variation in display color at a specified observation angle, which enhances the viewing-angle characteristic. The pixel electrodes 13 and 13' are formed so as to overlap the power lines 190 and 191 and are insulated from the power lines 190 and 191 by the protection insulation film 22.

Figure 7:
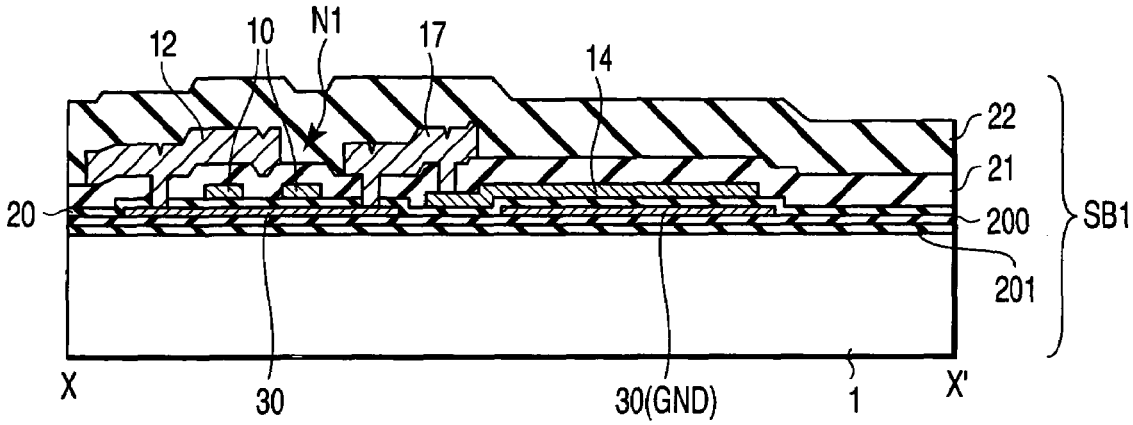
FIG. 7 shows the cross-sectional structure of the pixel circuit, taken along line X-X' in FIG. 6.
Figure 8:
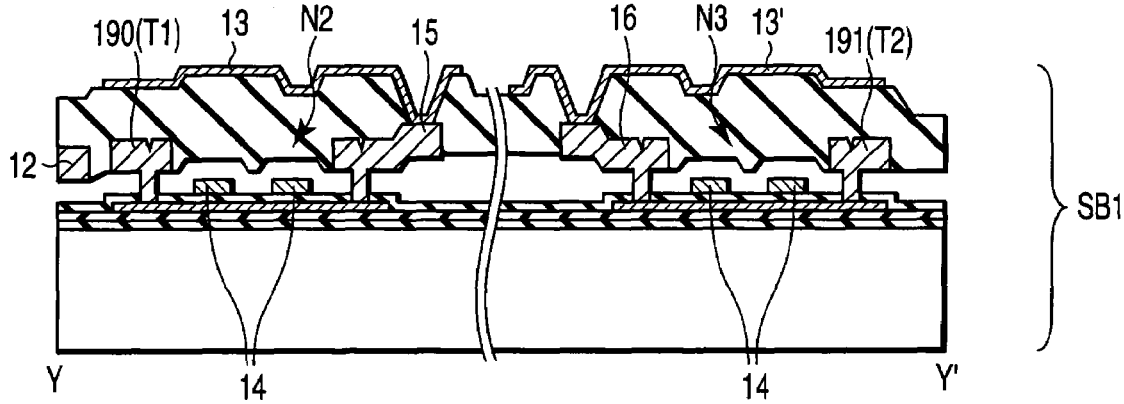
FIG. 8 shows the cross-sectional structure of the pixel circuit, taken along line Y-Y' in FIG. 6.
Figure 9:
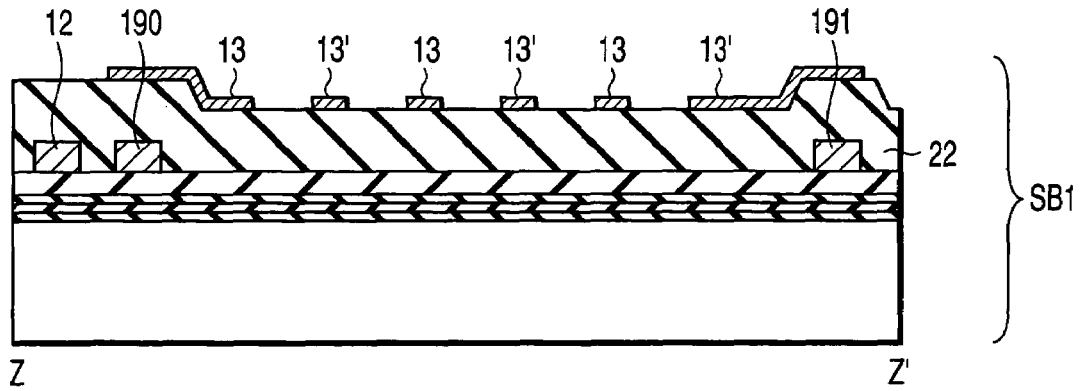
FIG. 9 shows the cross-sectional structure of the pixel circuit, taken along line Z-Z' in FIG. 6.

FIG. 7, FIG. 8 and FIG. 9 show cross-sectional structures of the pixel circuit PX, taken along lines X-X', Y-Y' and Z-Z' in FIG. 6. In the support substrate SB1, the glass substrate 1 is formed of no-alkali glass with a point of strain of about 670° C. An $SiN_x$ film 201 with a thickness of 50 nm and an $SiO_2$ film 200 with a thickness of 100 nm are formed on the glass substrate 1 as buffer insulation films. The buffer insulation films function to prevent diffusion of impurities, such as Na, from the glass substrate 1.

The transistors N1, N2 and N3 and common electrode line GND are formed by using a single-crystal film 30 with a thickness of 200 nm, which is formed on the $SiO_2$ film 200 and is divided into parts by patterning. In the single-crystal silicon film 30 of the transistors N1, N2 and N3, there are provided channel regions that are located under the gate electrodes, and $n^+$ source regions and drain regions that are disposed on both sides of the channel regions. The single-crystal silicon film 30 is covered with a gate insulation film 20 that is formed of $SiO_2$ with a thickness of 30 nm. The scan line 10, which serves also as the gate electrode of the sampling transistor N1, is formed on the gate insulation film 20. The connection electrode 14, which serves also as the gate electrode of the drive transistor N2, N3, is formed on the gate insulation film 20. The scan line 10 and connection electrode 14 are formed of tungsten (W). The connection electrode 14 partly overlaps the common electrode line GND via the gate insulation film 20, and the overlapping constitutes the storage capacitance Cs. An interlayer insulation film 21 of $SiO_2$ is formed so as to cover the scan line 10 and connection electrode 14. The contact through-holes CONT1 penetrate the interlayer insulation layer 21, or the interlayer insulation layer 21 and gate insulation film 20. The video signal line 12, connection electrodes 15, 16 and 17 and first and second power lines 190 and 191 are three-layer metal films of Mo/Al/Mo, which are formed on the interlayer insulation film 21. The three-layer metal films of Mo/Al/Mo are covered with a protection insulation film 22 of $SiN_x$. The pixel electrodes 13 and 13' are formed on the protection insulation film 22, as shown in FIG. 8 and FIG. 9. The contact through-holes CONT2 penetrate the protection insulation film 22.

Next, specific fabrication steps of the above liquid crystal display are described.

A no-alkali glass substrate 1 having a thickness of 500 μm, a width of 750 mm, a length of 950 mm and a stain point of 670° C. is washed. An $SiN_x$ film 201 with a thickness of 50 nm is formed on the glass substrate 1 by plasma CVD using a mixture gas of $SiH_4$, $NH_3$ and $N_2$. Subsequently, an $SiO_2$ film 200 with a thickness of 100 nm is formed by plasma CVD using a mixture gas of $SiH_4$, $N_2O$ and He.

Then, a substantially intrinsic hydrogenated amorphous silicon film with a thickness of 200 nm is formed by plasma CVD using a mixture gas of $SiH_4$ and Ar. The temperature for film formation is 400° C., and the amount of hydrogen immediately after the film formation is about 5 atoms %. Next, the substrate is annealed at 450° C. for about 30 minutes, thereby releasing hydrogen contained in the hydrogenated amorphous silicon film.

Subsequently, a cap SiON film with a thickness of 300 nm is formed by plasma CVD using a mixture gas of $SiH_4$, $NH_3$ and $O_2$ These plasma CVD and anneal steps are continuously performed in a vacuum, without exposing the substrate to atmospheric air.

Next, a step of changing the amorphous silicon film into a single-crystal film is performed. In the single-crystal forming step, it is preferable to adopt a laser anneal method using a KrF excimer layer beam source. In the laser anneal method, crystallization is optimally performed using a crystallizing apparatus wherein an optical system includes a phase shifter, which phase-modulates an incident laser beam, whose light intensity is homogenized by a homogenizer, and passes a laser beam with an inverse-peaked light intensity distribution. In the crystallization using the crystallizing apparatus, a crystallized region that is large enough to form one or more transistors can be formed by setting the energy of the laser beam at such a level that the irradiation surface may have a temperature that is equal to or higher than the melting point of the amorphous silicon film. The formation of a transistor in the crystallized region can increase the switching speed of the transistor.

The crystallization with a large grain size can be effected because the homogenized laser beam is radiated as a phase-modulated laser beam with an inverse-peaked light intensity distribution, and because the crystal is horizontally grown by the thermal storage effect of the cap film that is formed on the amorphous silicon film.

A method in which the entire region of the amorphous silicon film is crystallized also exists. However, there may be a case where the formation region of a pixel circuit Px of a large-sized liquid crystal display may be made into a broad screen of several decimeters squared. Further, there is a region that is more suited to some uses when it is formed of amorphous silicon than when it is formed of crystallized silicon. Thus, for example, a single-crystal forming step may be performed selectively on only the formation regions of the transistors N1, N2 and N3 on each pixel circuit Px.

Specifically, the formation regions of transistors N1, N2 and N3 on the amorphous silicon film are registered in advance, and these regions are irradiated with the phase-modulated laser beam having the inverse-peaked light intensity distribution by successively aligning the laser beam with the positions for irradiation. By repeating this step, insular crystallized regions can be formed on an amorphous silicon film with a desired size. The selective crystallization step may be performed by moving the laser beam emission side.

To be more specific, with application of a pulse excimer laser beam having a wavelength of 248 nm, the amorphous silicon film is melted and recrystallized, thereby forming a silicon film 30 that is partly single-crystallized. At this time, in order to obtain a single-crystal region having the largest possible area, the following method was adopted. That is, using a phase shifter with a proper pattern, the excimer laser beam was caused to have a spatial distribution in laser beam intensity at the surface of the substrate and to have a temperature gradient in the lateral (horizontal) direction. Thereby, horizontal crystal growth was facilitated and an array of substantially rectangular single-crystal regions each having one side of about 4 μm was obtained.

In a subsequent step, the cap (SiON) film is removed by buffer hydrofluoric acid, and the silicon film 30 is processed to have a predetermined pattern by an ordinary photolithographic method.

An oxide film with a thickness of 4 nm is formed on the surface of the silicon film 30 by plasma oxidation in a mixture gas of Kr and $O_2$. Then, an $SiO_2$ film with a thickness of 24 nm is formed by plasma CVD using a mixture gas of tetraethoxysilane (TEOS) and $O_2$ Thus, two-layer-stacked gate oxide film is obtained.

Next, boron (B+) is ion-implanted with an acceleration voltage of 20 KeV and a dose of $1\times10^{11}$ $cm^{-2}$. The boron serves to adjust the threshold voltage of the TFT.

Using a sputtering method, a tungsten film with a thickness of 250 nm is formed. Then, using an ordinary photolithographic method, a predetermined resist pattern is formed on the tungsten (W) film. The W film is processed to have a predetermined shape by reactive ion etching (RIE) using $CF_4$. Thus, a scan line is obtained. In the state in which the resist pattern used for etching is left, phosphorous (P) ions are ion-implanted with an acceleration voltage of 40 KeV and a dose of $1\times10^{15}$ $cm^{-2}$. Thus, source and drain regions of the N-channel thin-film transistor are formed.

Subsequently, with the resist pattern being left, the substrate is processed using a mixed acid. The processed Mo electrode is subjected to side etching and the pattern is slimmed. After the resist is removed, P ions are ion-implanted with an acceleration voltage of 40 KeV and a dose of $1\times10^{13}$ $cm^{-2}$. Thus, an LDD (Lightly Doped Drain) region for the N-channel TFT is formed. The length of the LDD region is controlled by the duration of the side etching using the mixed acid.

After the photoresist is removed, the implanted impurities are activated by rapid thermal anneal (RTA) by applying ultraviolet of an excimer lamp or a metal halide lamp to the substrate.

Next, an $SiO_2$ film with a thickness of 500 nm is formed by plasma CVD using a mixture gas of tetraethoxysilane and oxygen, and an interlayer insulation film 21 is formed. After a predetermined resist pattern is formed, dry etching is performed using $CHF_3$, thus forming contact through-holes in the interlayer insulation film 21. Then, using a sputtering method, Ti with a thickness of 50 nm, Al—Si—Cu alloy with a thickness of 500 nm and Ti with a thickness of 50 nm are successively stacked. After forming a predetermined resist pattern, these are etched as a batch by reactive ion etching (RIE) using a mixture gas of $BCl_3$ and $Cl_2$. Thus, a video signal line 12, connection electrodes and liquid crystal drive power lines 190 and 191 are obtained.

An $Si_3N_4$ film with a thickness of 400 nm is formed by plasma CVD using a mixture gas of $SiH_4$, $NH_3$ and $N_2$, and thus a protection insulation film 22 is obtained. After a predetermined photoresist pattern is formed, contact through-holes are formed in the protection insulation film 22 by dry etching using $SF_6$.

Then, an ITO (Indium Tin Oxide) film with a thickness of 70 nm is formed by sputtering and is processed to have a predetermined shape by wet etching using a mixed acid. Thus, first and second pixel electrodes 13 and 13' are obtained.

Subsequently, a liquid crystal layer, etc. are formed by conventional fabrication steps.

In the above example of fabrication, the single-crystal silicon film is used as a semiconductor layer of the thin-film transistor. Thus, non-uniformity in threshold voltage between a plurality of thin-film transistors, which are formed in the substrate, can sufficiently be reduced, which realizes uniform image display.

In this example, the single-crystal silicon film is used as a semiconductor layer. Alternatively, polysilicon or amorphous silicon may be used as material of the semiconductor layer, and the thin-film transistor may be formed in this semiconductor layer.

According to the above-described embodiment, with the application of a liquid crystal drive voltage from the pixel electrodes 13 and 13', a lateral electric field, which is substantially parallel to the plane of these electrodes, i.e. the surface of the substrate, is created in the liquid crystal layer 506. At this time, liquid crystal molecules are rotated in the plane of the substrate, thereby controlling the polarization direction of transmission light. Specifically, since an image can be displayed without raising the liquid crystal molecules relative to the plane of the substrate, the observation-angle dependency of contrast due to birefringence of liquid crystal molecules can substantially be eliminated, and a high-image-quality liquid crystal display with a wide viewing angle can be obtained.

Figure 10:
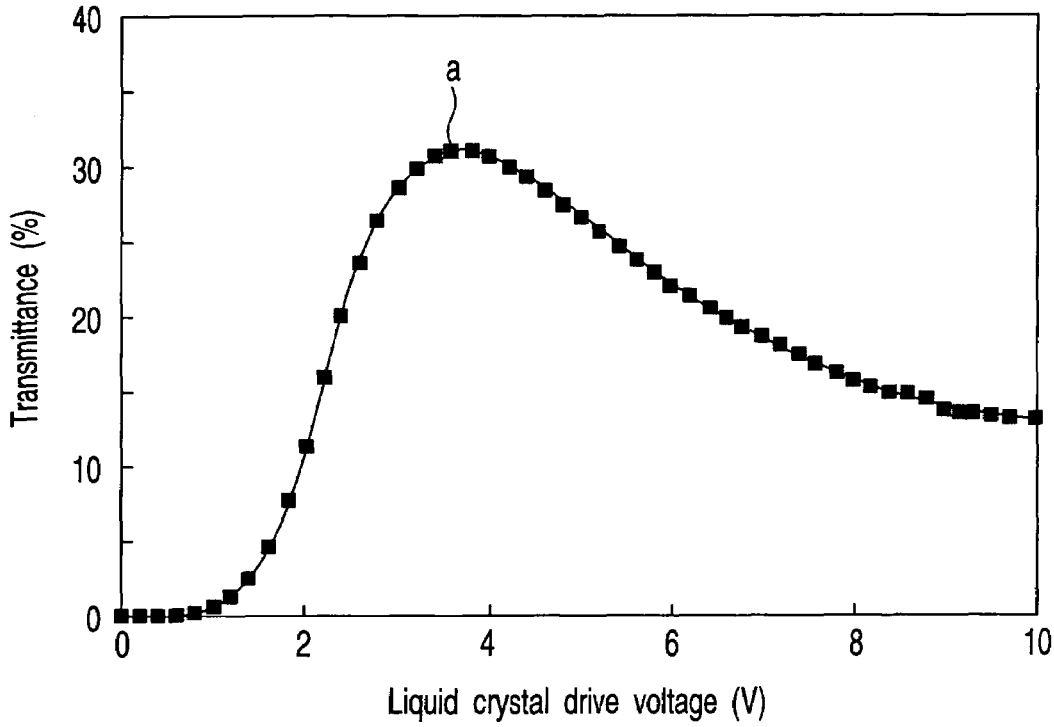
FIG. 10 is a graph showing the voltage-luminance characteristic of the liquid crystal display shown in FIG. 1.

FIG. 10 shows the voltage-luminance characteristic of this liquid crystal display. Specifically, FIG. 10 indicates the transmittance of the liquid crystal layer 506, relative to the liquid crystal drive voltage that is applied to the pixel electrodes 13 and 13'. In this case, a nematic liquid crystal, which has a dielectric anisotropy $\Delta\epsilon$ with a positive value of 7, and a refractive anisotropy $\Delta n$ of 0.073, was used as a liquid crystal composition of the liquid crystal layer 506. In this embodiment, the liquid crystal with the positive dielectric anisotropy $\Delta\epsilon$ was used, but a liquid crystal with a negative dielectric anisotropy $\Delta\epsilon$ may be used. The alignment films ORI1 and ORI2 are subjected to a rubbing treatment in substantially parallel directions such that a pre-tilt angle of 1° may be set. A gap d between the support substrates SB1 and SB2 is set at 4.5 μm by dispersing spherical polymer beads in the liquid crystal layer 506. As regards two polarizer plates 505, the polarized-light transmission axis of one of the polarizer plates 505 is set at 85°, which is substantially parallel to the rubbing direction. The polarized-light transmission axis of the other polarizer plates 505 is set at −5°, which is perpendicular to the polarized-light transmission axis of the aforementioned one polarizer plates 505. Thus, a liquid crystal display with the normally close characteristic was obtained.

In the present embodiment, the liquid crystal pixel memory comprises the first and second power terminals T1 and T2, first and second pixel electrodes 13 and 13' and first and second drive transistors N2 and N3. The first and second pixel electrodes 13 and 13' apply a liquid crystal drive voltage to the liquid crystal layer 506, thereby creating a lateral electric field in the liquid crystal layer 506. The first and second drive transistors N2 and N3 include gate electrodes that receive the video signal, and current paths that are connected between the first power terminal T1 and first pixel electrode 13, and between the second power terminal T2 and second pixel electrode 13', respectively. The liquid crystal drive voltage, which is determined by the conductances that vary in accordance with the video signal, is retained in the liquid crystal capacitance CLC between the first and second pixel electrode 13 and 13'. The liquid crystal capacitance CLC serves as a liquid crystal pixel memory.

By repeatedly reversing the relationship in potential between the first and second power terminals T1 and T2 at proper cycles, the polarity of the liquid crystal drive voltage that is retained in the liquid crystal capacitance CLC between the first and second pixel electrodes 13 and 13' can be reversed. In this case, refreshing of the video signal, which is supplied to the gate electrodes of the first and second drive transistors N2 and N3, is not needed in order to reverse the polarity of the liquid crystal drive voltage VLC. In other words, if the liquid crystal voltage VLC that is proportional to the video signal voltage Vs is retained in the liquid crystal capacitance CLC between the first and second pixel electrodes 13 and 13', the polarity of the liquid crystal drive voltage VLC can be reversed automatically. As a result, it becomes possible to reduce the refreshing frequency, i.e. the refresh rate, with which a video signal processing circuit such as a signal line driver LSI refreshes the video signal for one frame, and to reduce the power consumption in this video signal processing circuit. Moreover, since the video signal voltage itself is not used as the liquid crystal drive voltage VLC that requires cyclic polarity reversal, it is possible to supply, as a video signal, a unipolar analog voltage having a maximum amplitude that is half the maximum amplitude of the prior art. Thereby, the power that is consumed to drive the video signal line 12 in accordance with the video signal voltage Vs can be reduced. Furthermore, since the structure of the video signal circuit can be simplified, the manufacturing cost of the driver LSI can be reduced. Furthermore, since the video signal line 12 and the power line 190, 191 are arranged in parallel, horizontal electric field noise can be shielded by the power lines 190 and 191. Further, since the pixel electrode 13, 13' is formed to overlap the power line 190, 191, the reduction in aperture ratio can be minimized.

Second Embodiment

Figure 12:
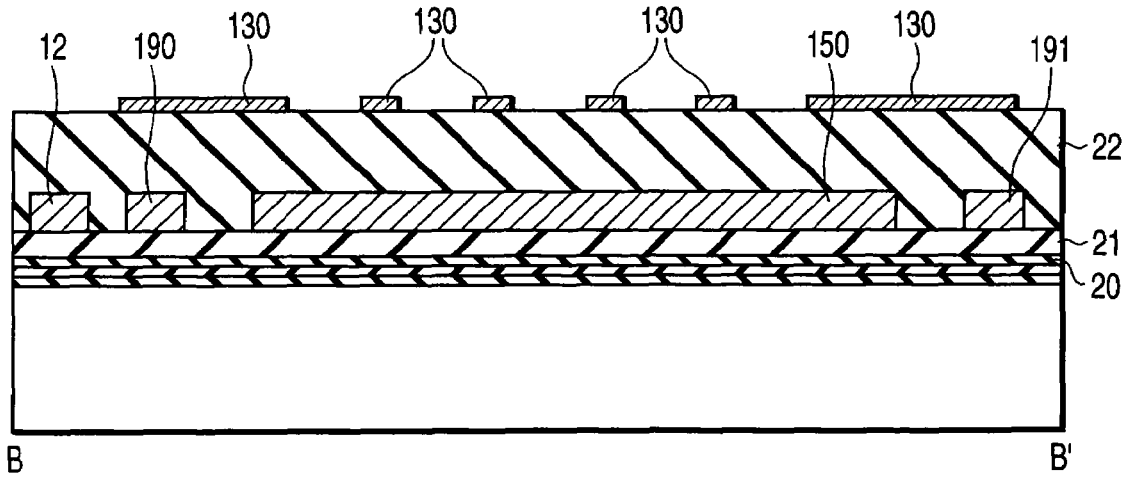
FIG. 12 shows the cross-sectional structure of the pixel circuit, taken along line B-B' in FIG. 11.
Figure 11:
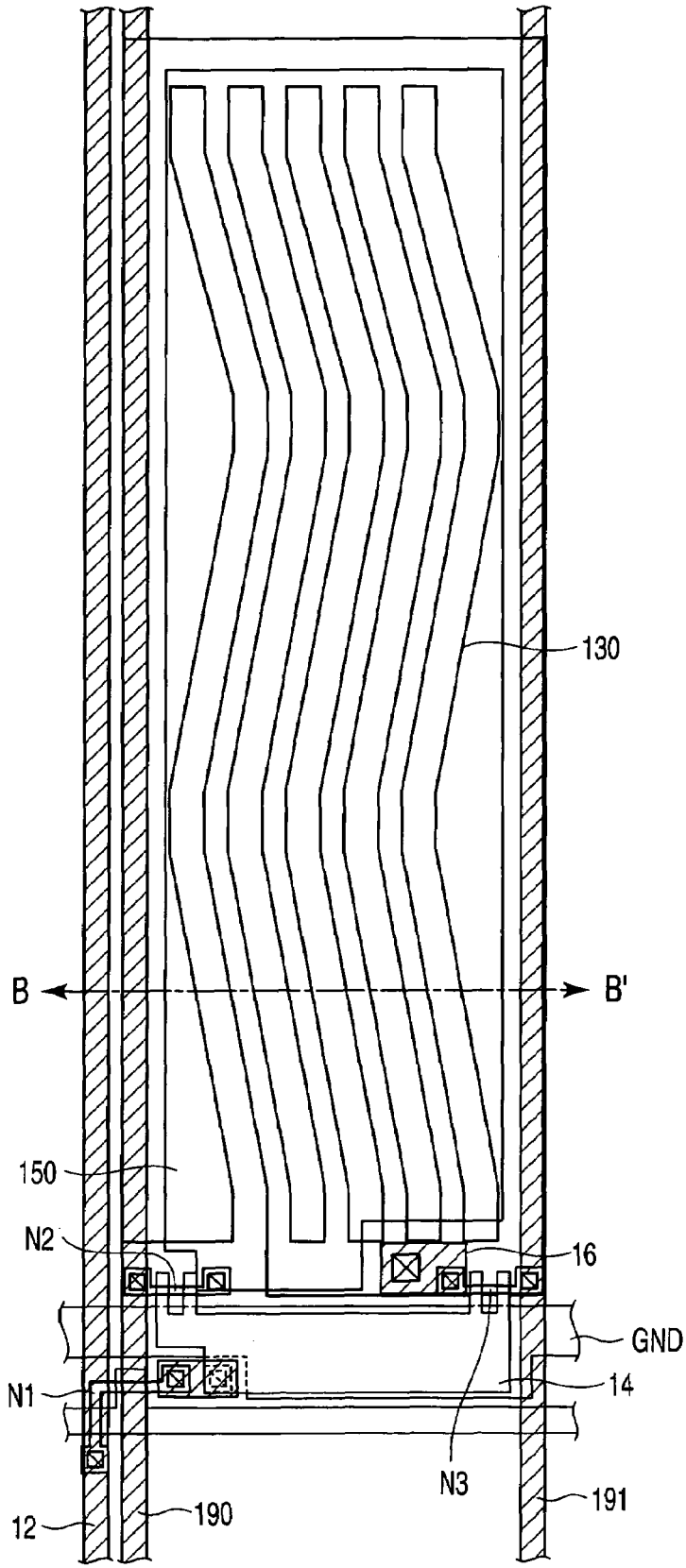
FIG. 11 shows the plan-view structure of a pixel circuit of a reflection-type active matrix liquid crystal display according to a second embodiment of the present invention.

A reflection-type active matrix liquid crystal display according to a second embodiment of the present invention will now be described. FIG. 11 shows the plan-view structure of a pixel circuit PX of the reflection-type active matrix liquid crystal display, and FIG. 12 shows the cross-sectional structure of the pixel circuit PX, taken along line B-B' in FIG. 11.

This liquid crystal display is substantially the same as the liquid crystal display of the first embodiment, except for the electrode structure for reflecting ambient light. In FIG. 11 and FIG. 12, the parts similar to those in the first embodiment are denoted by the same reference numerals, and a detailed description of, e.g. film materials and stacked structures is omitted.

This liquid crystal display has the same circuit configuration as has been described with reference to FIG. 2 and FIG. 3. The first pixel electrode 13 and the second pixel electrode 13' of the first embodiment, however, are replaced with a pixel electrode 130 and a reflective electrode 150, respectively. The first pixel electrode 130 is formed of a transparent electrode of, e.g. ITO (Indium Tin Oxide), which has a comb-shaped planar pattern that is bent, as shown in FIG. 11. The first pixel electrode 130 passes ambient light, which is incident via the liquid crystal layer 506. The width of each comb tooth of the first pixel electrode 130 is set at 3 μm, and the distance between adjacent two teeth is set at 7 μm. The bending of each tooth, like the first embodiment, can prevent a variation in display color at a specified observation angle, which enhances the viewing-angle characteristic. The first pixel electrode 130 is formed so as to overlap the power line 190, 191 and is insulated from the power line 190, 191 by the protection insulation film 22. As is shown in FIG. 11, the reflective electrode 150 is a metal film that is disposed to overlap all the comb teeth of the pixel electrode 130 and reflects ambient light that has passed through the pixel electrode 130. In FIG. 12, a three-layer metal film of Mo/Al/Mo that is formed as the reflective electrode 150 on the interlayer insulation film 21. Alternatively, the reflective electrode 150 may be a metal film of tungsten (W) that is formed on the gate insulation film 20. The pixel electrode 130 is connected to the power terminal T1 via the current path of the drive transistor N2, and the reflective electrode 150 is connected to the power terminal T2 via the current path of the drive transistor N3. In this case, the liquid crystal layer 506 is driven by a fringe electric field that is created between the pixel electrode 130 and reflective electrode 150. The fringe electric field is a substantially lateral electric field in the liquid crystal layer 506.

In this embodiment, the same advantages as with the first embodiment can be obtained by the reflection-type active matrix liquid crystal display that displays an image using reflective light. Since the backlight BL is not needed, the power consumed by the backlight BL can be subtracted from the total power consumption of the entire display device. Furthermore, since the pixel electrode 130 is formed to overlap the power line 190, 191, the aperture ratio can be enhanced.

Third Embodiment

Figure 13:
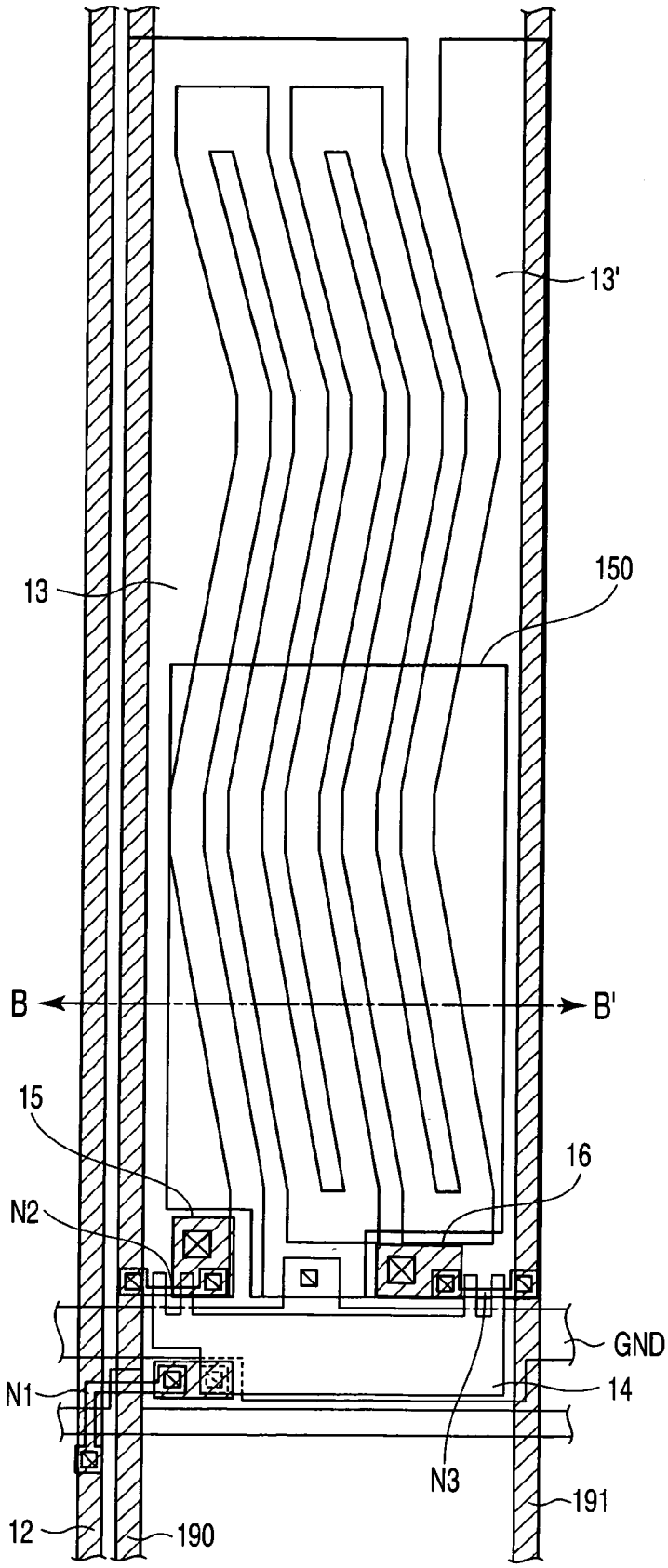
FIG. 13 shows the plan-view structure of a pixel circuit of a semi-transmission-type ("transflective") active matrix liquid crystal display according to a third embodiment of the present invention.
Figure 14:
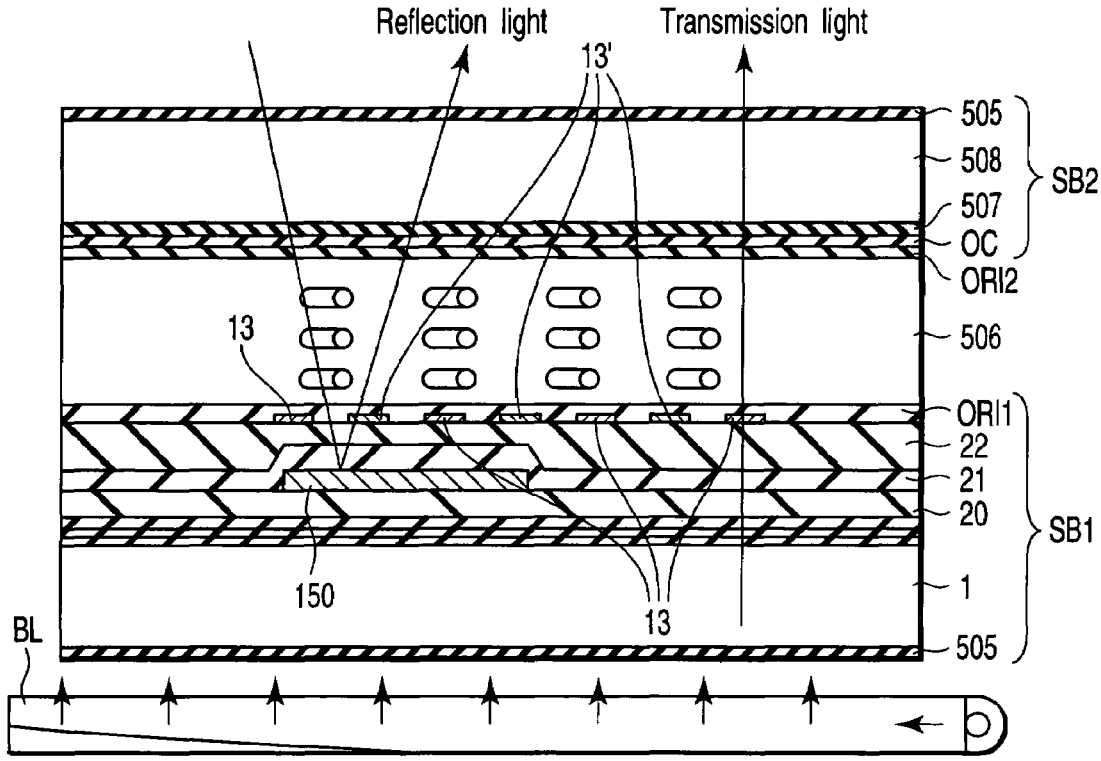
FIG. 14 shows the cross-sectional structure of the pixel circuit, taken along line B-B' in FIG. 13.

A semi-transmission-type ("transflective") active matrix liquid crystal display according to a third embodiment of the present invention will now be described. FIG. 13 shows the plan-view structure of a pixel circuit PX of the semi-transmission-type active matrix liquid crystal display, and FIG. 14 shows the cross-sectional structure of the liquid crystal display, taken along line B-B' in FIG. 13. This liquid crystal display is substantially the same as the liquid crystal display of the first embodiment, except for the electrode structure for transmitting backlight and reflecting ambient light. In FIG. 13 and FIG. 14, the parts similar to those in the first embodiment are denoted by the same reference numerals, and a detailed description of, e.g. film materials and stacked structures is omitted.

The liquid crystal display has the circuit configuration that is described with reference to FIG. 2 and FIG. 3. A reflective electrode 150, however, is provided in addition to the pixel electrodes 13 and 13' of the first embodiment. The pixel electrode 13, 13' is formed of a transparent electrode of, e.g. ITO (Indium Tin Oxide), which has a comb-shaped planar pattern that is bent, as shown in FIG. 13. The pixel electrodes 13 and 13' pass both ambient light, which is incident via the liquid crystal layer 506, and backlight, which is emitted from the backlight BL. Like the first embodiment, the pixel electrode 13, 13' is formed of a transparent electrode of, e.g. ITO, which has an intermeshing, bent comb-shaped planar pattern as shown in FIG. 13. The width of each comb tooth of the pixel electrode 13, 13' is set at 3 μm, and the gap between the pixel electrodes 13 and 13', that is, the distance between adjacent two teeth, is set at 7 μm. The bending of each tooth can prevent a variation in display color at a specified observation angle, which enhances the viewing-angle characteristic. The pixel electrode 13, 13' is formed so as to overlap the power line 190, 191 and is insulated from the power line 190, 191 by the protection insulation film 22. Unlike the second embodiment, the reflective electrode 150 is a metal film that is disposed to overlap about half the area of the comb teeth of the pixel electrodes 13, 13', as shown in FIG. 13, and, like the second embodiment, reflects ambient light that has passed through the pixel electrode 13, 13'. In FIG. 14, a metal film of tungsten (W) is formed as reflective electrode 150 on the gate insulation film 20. The reflective electrode 150 may be a three-layer metal film of Mo/Al/Mo that is formed on the interlayer insulation film 21. In this liquid crystal display, that part of the pixel area, which is occupied by the reflective electrode 150, constitutes a reflection display section, and the part of the pixel area that excludes the reflection display section constitutes a transmission display section. The pixel electrode 13 is connected to the power terminal T1 via the current path of the drive transistor N2, the pixel electrode 13' is connected to the power terminal T2 via the current path of the drive transistor N3, and the reflective electrode 150 is connected to the common electrode line GND with a ground potential via a contact through-hole. In this case, the liquid crystal layer 506 is driven by a lateral electric field that is created between the pixel electrodes 13 and 13', and a fringe electric field that is created between the pixel electrode 13, 13' and the reflective electrode 150 and substantially becomes a lateral electric field in the liquid crystal layer 506. Thereby, the uniformity of the electric field between the pixel electrodes 13 and 13' is enhanced, and a high-quality display image can be obtained.

In this embodiment, the same advantages as with the first embodiment can be obtained by the semi-transmission-type active matrix liquid crystal display that displays an image using transmission light and reflection light.

Figure 15:
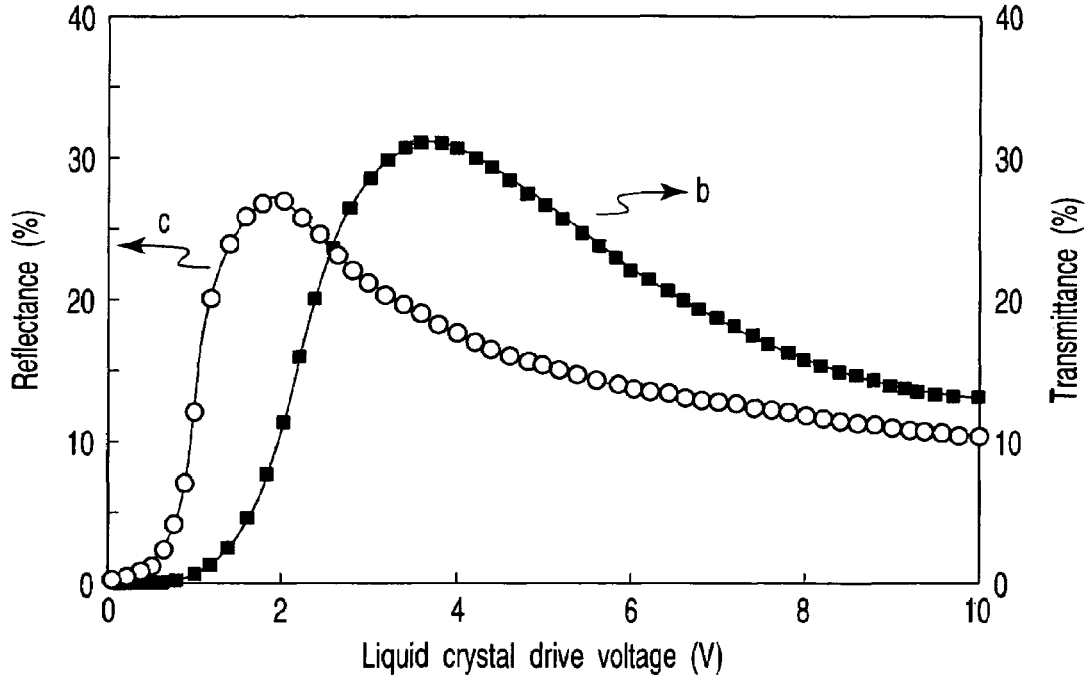
FIG. 15 is a graph showing the voltage-luminance characteristic of the liquid crystal display shown in FIG. 14.

FIG. 15 shows the voltage-luminance characteristic of this liquid crystal display. In FIG. 15, a curve b indicates the dependency of the transmittance obtained by the transmission display section upon the liquid crystal drive voltage, and a curve c indicates the dependency of the reflectance obtained by the reflection display section upon the liquid crystal drive voltage. A good voltage-luminance characteristic is obtained both in reflection display and transmission display.

The semi-transmission type liquid crystal display that uses both reflection light and transmission light is suitably applied to a small-sized device, such as a portable phone or a portable information terminal, which is frequently used outdoors. Making use of the pixel structure of this embodiment, the power consumption of the device can be reduced according to the decrease in the drive voltage. Moreover, high-quality image display is realized by the wide viewing angle, which is an advantage of the lateral electric field drive scheme.

Fourth Embodiment

Figure 16:
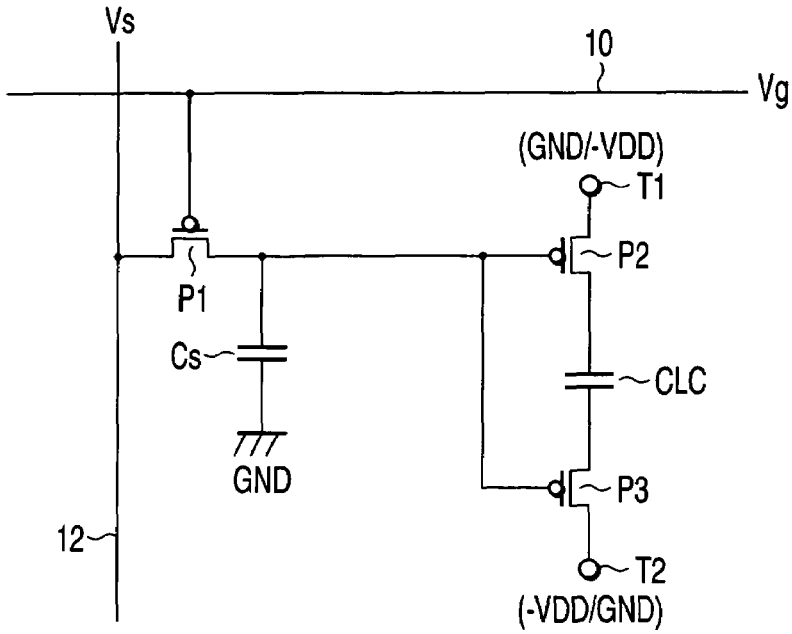
FIG. 16 shows an equivalent circuit of one of the pixel circuits that are arrayed in a matrix in an active matrix liquid crystal display according to a fourth embodiment of the present invention.
Figure 17:
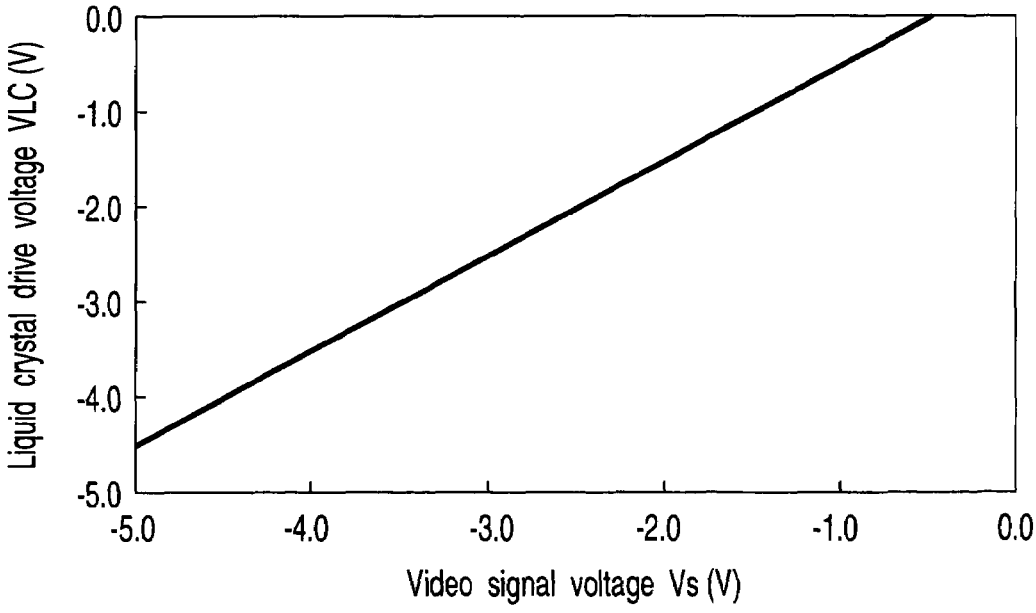
FIG. 17 is a graph showing the voltage input/output characteristic of the pixel circuit shown in FIG. 16.

An active matrix liquid crystal display according to a fourth embodiment of the present invention will now be described. FIG. 16 shows an equivalent circuit of one of pixel circuits PX that are arrayed in a matrix in this active matrix liquid crystal display, and FIG. 17 is a graph showing the voltage input/output characteristic of the pixel circuit PX shown in FIG. 16.

This liquid crystal display is substantially the same as the liquid crystal display of the first embodiment, except that the pixel circuit PX is formed using PMOS thin film transistors (TFTs). In FIG. 16 and FIG. 17, the parts similar to those in the first embodiment are denoted by the same reference numerals, and a detailed description thereof is omitted.

Specifically, a sampling transistor P1 and first and second drive transistors P2 and P3, which are shown in FIG. 16, are formed of P-channel thin film transistors. In FIG. 17, the abscissa indicates the video signal voltage Vs that is input from the video signal line, and the ordinate indicates the liquid crystal drive voltage VLC that is applied between the paired pixel electrodes 13 and 13'.

In the case where the transistors P1, P2 and P3 have a PMOS structure, these transistors can be driven by a negative input gate voltage. The absolute value of the liquid crystal drive voltage VLC becomes lower than the input gate voltage, i.e. video signal voltage Vs, by a degree corresponding to the threshold voltage Vt of the drive transistor P2, P3. In a case where the video signal voltage Vs is less than the threshold voltage Vt, the liquid crystal drive voltage VLC becomes 0.

In particular, if the drive transistor P2, P3 is formed with a PMOS structure having a high source-drain withstand voltage, a higher liquid crystal drive voltage can be applied to the liquid crystal layer 506. Further, compared to the nmOS structure, the PMOS structure is less degraded by hot carriers and, therefore, a highly reliable display device can be obtained.

Fifth Embodiment

Figure 18:
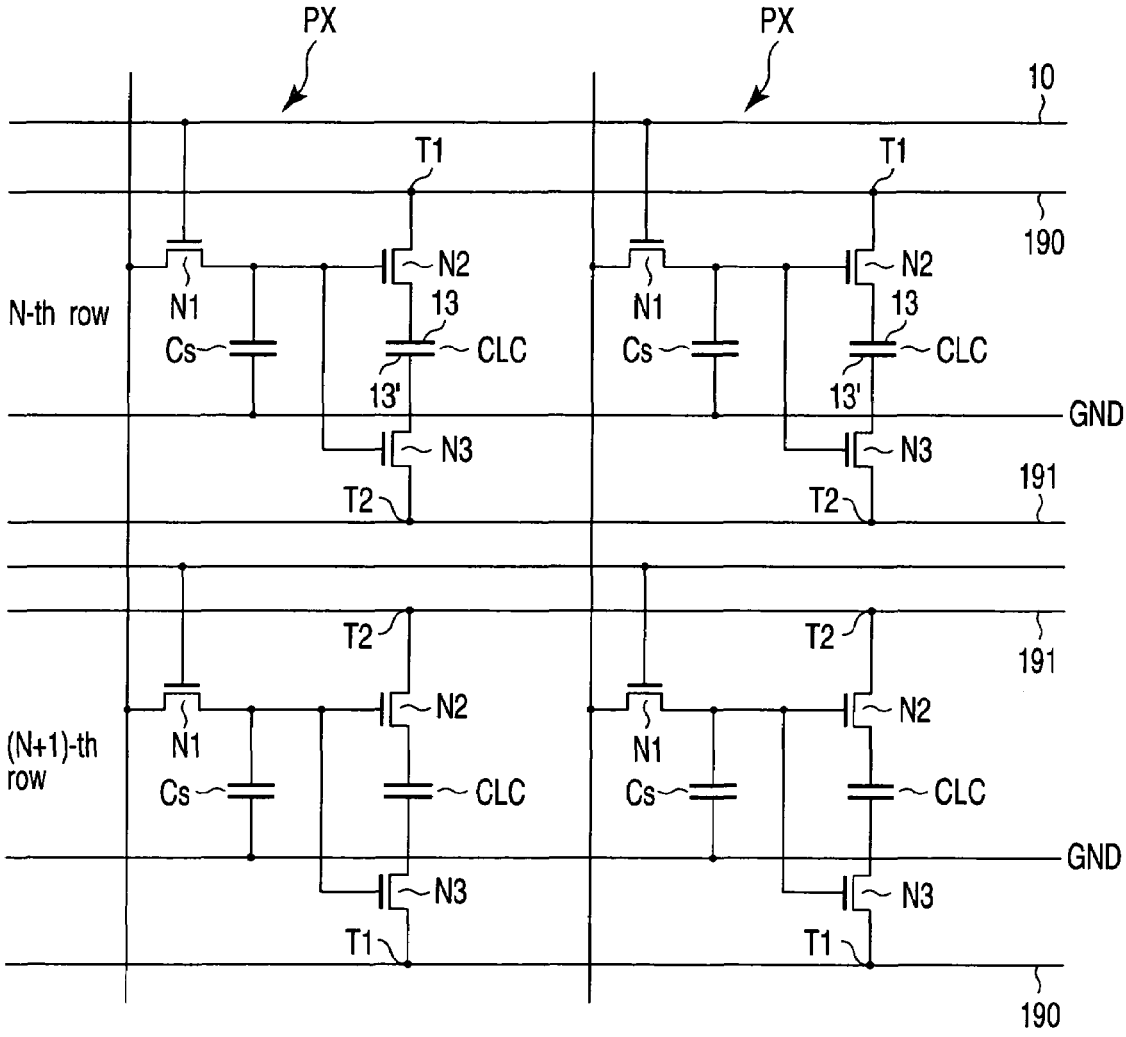
FIG. 18 schematically shows the plan-view structure of a screen part in an active matrix liquid crystal display according to a fifth embodiment of the present invention.
Figure 19:
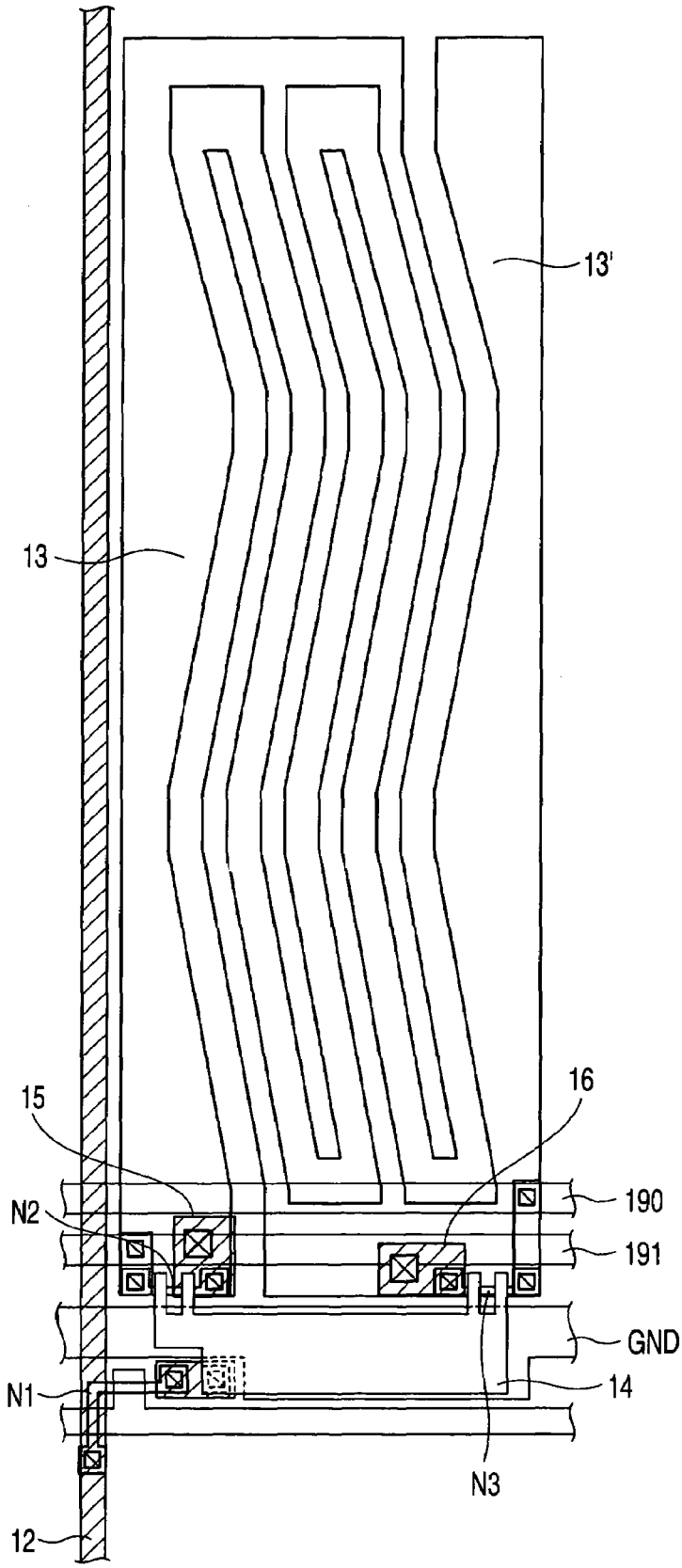
FIG. 19 shows the plan-view structure of a pixel circuit shown in FIG. 18.

An active matrix liquid crystal display according to a fifth embodiment of the present invention will now be described. FIG. 18 schematically shows the plan-view structure of a screen part in this active matrix liquid crystal display, and FIG. 19 shows the plan-view structure of a pixel circuit PX shown in FIG. 18.

This liquid crystal display is substantially the same as the liquid crystal display of the first embodiment, except that the arrangement of power lines is modified such that lateral electric fields created by pixel circuits PX are not set in the same direction. In FIG. 18 and FIG. 19, the parts similar to those in the first embodiment are denoted by the same reference numerals, and a detailed description thereof is omitted.

In this liquid crystal display, the first and second power lines 190 and 191 are arranged in parallel to the scan lines 10. In addition, the positional relationship between the power lines 190 and 191 is reversed between pixel circuits PX in adjacent rows in order to transpose the power terminals T1 and T2. Specifically, in the pixel circuit PX in an N-th row, the power line 190 constitutes the power terminal T1 that is connected to the drain of the drive transistor N2, and the power line 191 constitutes the power terminal T2 that is connected to the drain of the drive transistor N3. On the other hand, in the pixel circuit PX in an (N+1)-th row, the power line 190 constitutes the power terminal T2 that is connected to the drain of the drive transistor N3, and the power line 190 constitutes the power terminal T1 that is connected to the drain of the drive transistor N2.

Not only in the lateral electric field driving mode but also in other driving modes in general, if lateral electric fields are created in the same direction in all rows, a flicker tends to occur due to slight asymmetry in the voltage-luminance characteristic (transmittance or reflectance relative to the liquid crystal drive voltage), which occurs at a time of polarity reversal.

According to the architecture of this embodiment, however, such flicker can be prevented since lateral electric fields in opposite directions are created in the pixel circuits PX in adjacent rows.

Sixth Embodiment

Figure 20:
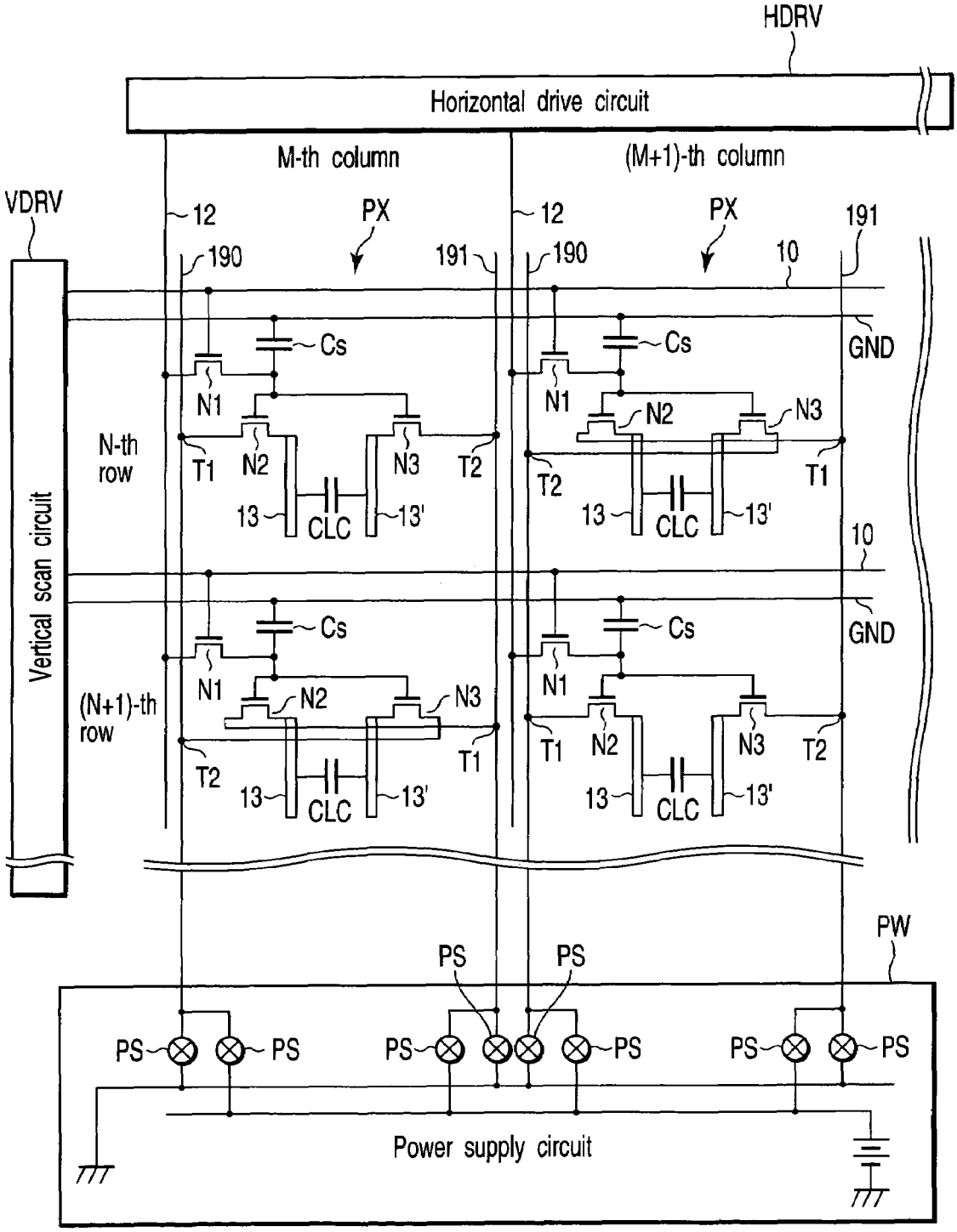
FIG. 20 schematically shows the plan-view structure of an active matrix liquid crystal display according to a sixth embodiment of the present invention.

An active matrix liquid crystal display according to a sixth embodiment of the present invention will now be described. FIG. 20 schematically shows the plan-view structure of this liquid crystal display.

This liquid crystal display is substantially the same as the liquid crystal display of the first embodiment, except that the wiring structure in the pixel circuits is modified such that lateral electric fields created by pixel circuits PX are not set in the same direction. In FIG. 20, the parts similar to those in the first embodiment are denoted by the same reference numerals, and a detailed description thereof is omitted.

In this liquid crystal display, like the first embodiment, the first and second power lines 190 and 191 are arranged in parallel to the video signal lines 12. In this case, unlike the fifth embodiment, the power lines 190 and 191 are not arranged in parallel to the scan lines 10. Instead, the drain lines of the drive transistors N2 and N3 are reversely wired between the pixel circuits PX in adjacent rows and in adjacent columns in order to interchange the power lines 190 and 191 that constitute the first and second power terminals T1 and T2. Specifically, in the pixel circuit PX at an intersection of an N-th row and M-th column and in the pixel circuit PX at an intersection of an (N+1)-th row and (M+1)-th column, the drain of the drive transistor N2 is connected to the power terminal T1 that is constituted by the power line 190, and the drain of the drive transistor N3 is connected to the power terminal T2 that is constituted by the power line 191. On the other hand, in the pixel circuit PX at an intersection of the (N+1)-th row and M-th column and the pixel circuit PX at an intersection of the N-th row and (M+1)-th column, the drain of the drive transistor N2 is connected to the power terminal T1 that is constituted by the power line 191, and the drain of the drive transistor N3 is connected to the power terminal T2 that is constituted by the power line 190.

Thus, lateral electric fields in opposite directions are created in the pixel circuits PX in adjacent rows and adjacent columns. In other words, an architecture similar to a dot-reversal driving architecture for an ordinary TN mode liquid crystal can be realized by hardware, and flicker can be prevented as in the fifth embodiment.

In this embodiment, four adjacent pixel circuits PX constitute one group, but the combination and number of pixel circuits PX, which constitute one group, may be changed, as desired.

Seventh Embodiment

Figure 21:
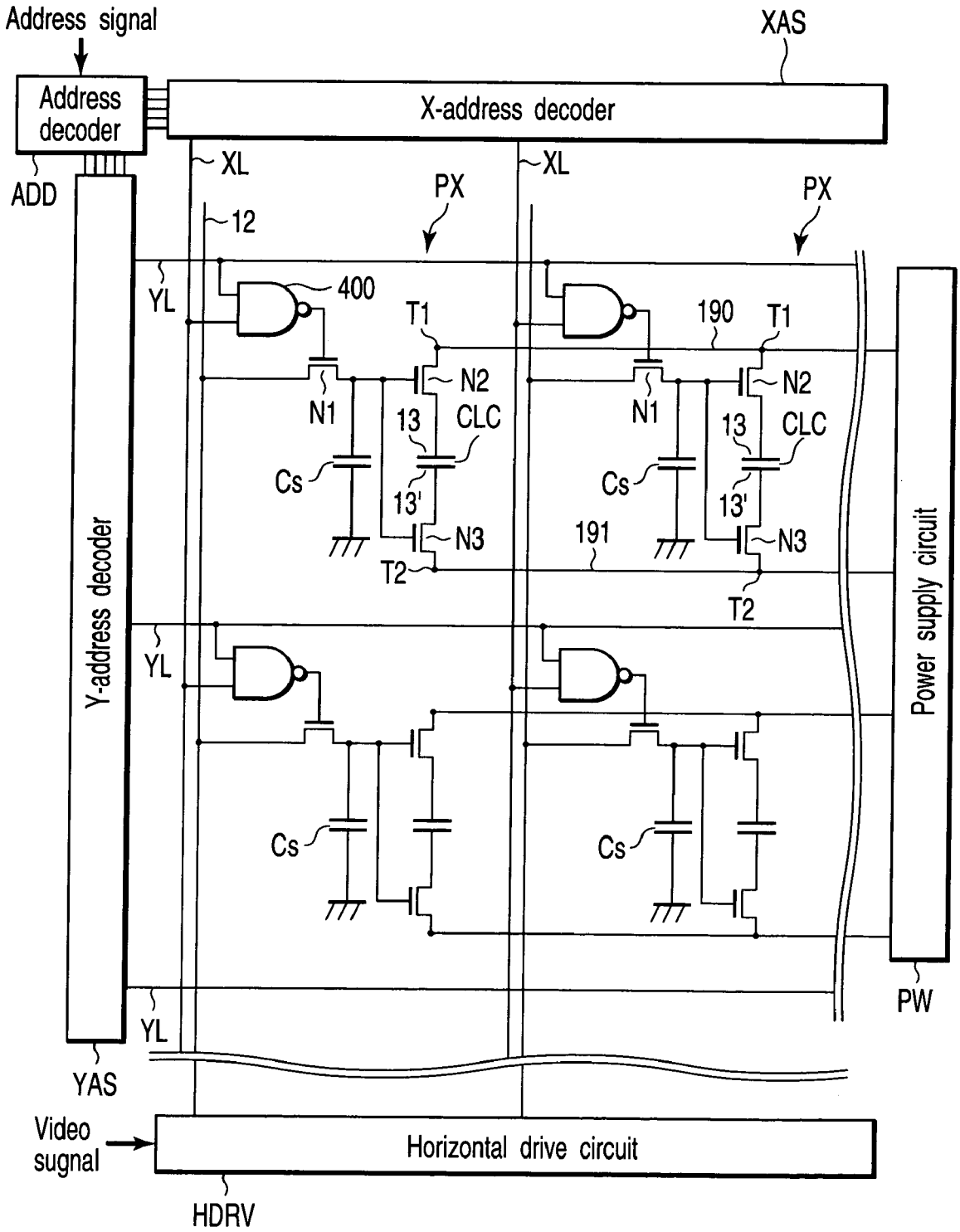
FIG. 21 schematically shows the plan-view structure of an active matrix liquid crystal display according to a seventh embodiment of the present invention.
Figure 22:
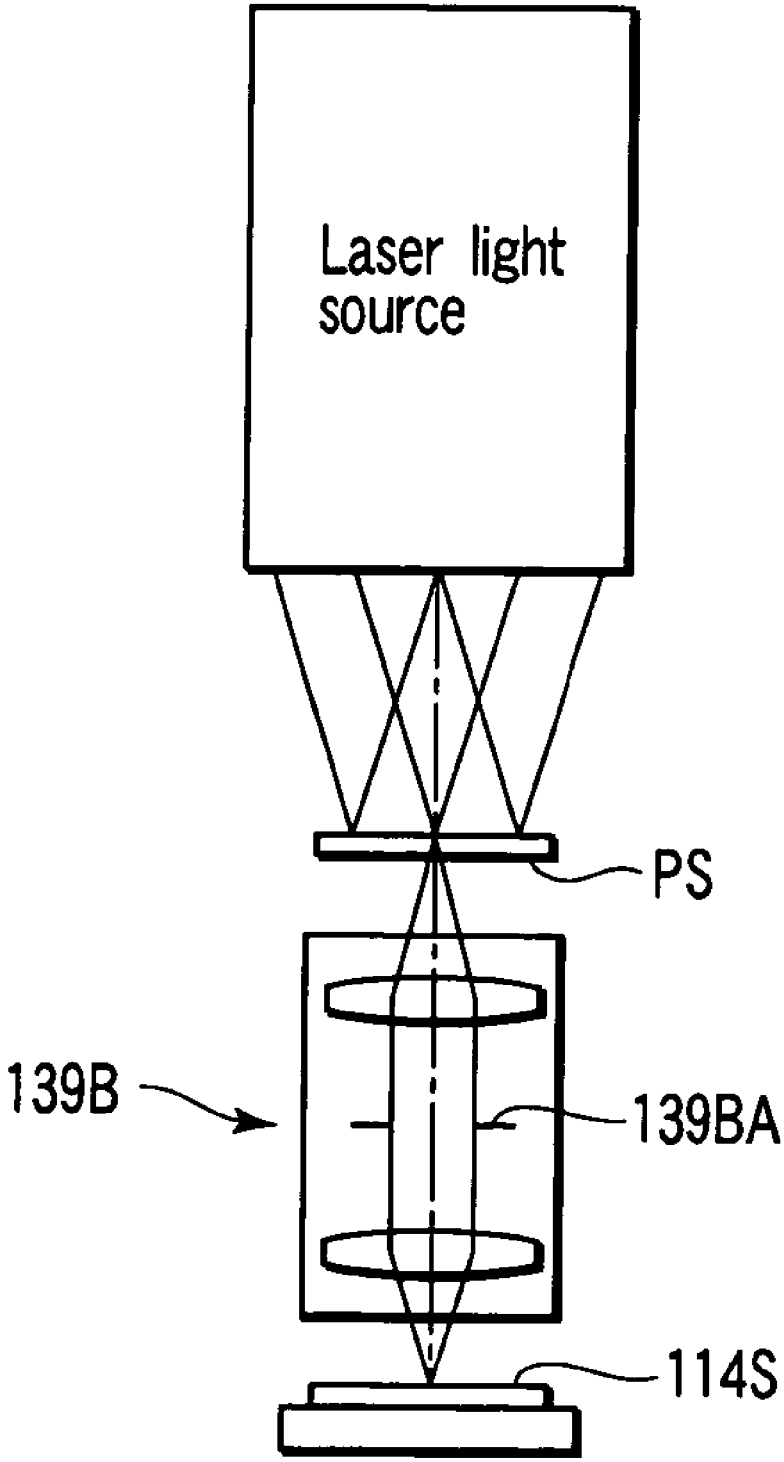
FIG. 22 is a view showing a laser crystallization apparatus for recrystallizing a non-single crystal semiconductor film into a single crystal semiconductor film used to form thin-film transistors.

An active matrix liquid crystal display according to a seventh embodiment of the present invention will now be described. FIG. 21 schematically shows the plan-view structure of this liquid crystal display.

This liquid crystal display is substantially the same as the liquid crystal display of the first embodiment, except for the structure of random access pixel circuits PX. In FIG. 21, the parts similar to those in the first embodiment are denoted by the same reference numerals, and a detailed description thereof is omitted.

As is shown in FIG. 21, in this liquid crystal display, the support substrate SB1 additionally includes a plurality of Y-address lines YL arranged along the rows of pixel circuits PX; a plurality of X-address lines XL arranged along the columns of the pixel circuits PX; a Y-address decoder YAS that drives the Y-address lines YL; an X-address decoder XAS that drives the X-address lines XL; and an address decoder ADD that controls the Y-address decoder YAS and the X-address decoder XAS. Each of the pixel circuits PX includes a NAND gate circuit 400 having two input terminals connected to one Y-address line and one X-address line XL, and an output terminal connected to the gate electrode of the sampling transistor N1. An address signal is supplied from the outside to the address decoder ADD via an address bus. A video signal for one pixel is supplied to the horizontal drive circuit HDRV in synchronism with the address signal. The horizontal drive circuit HDRV is configured to be able to output the video signal voltage Vs to one of the video signal lines 12 in units of the video signal for one pixel. In the first embodiment, the scan lines 10 and the vertical scan circuit VDRV, as shown in FIG. 2, are provided on the support substrate SB1. These components, however, are needless in the present embodiment.

If an address signal is input to the decoder ADD, the decoder ADD divides the address signal into a Y-address signal and an X-address signal and delivers the Y-address signal and X-address signal to the Y-address decoder YAS and X-address decoder XAS. The Y-address decoder YAS selects one of the Y-address lines YL, which is designated by the Y-address signal. The Y-address decoder YAS outputs a select signal to the selected Y-address line YL. On the other hand, the X-address decoder XAS selects one of the X-address lines XL, which is specified by the X-address signal, and outputs a select signal to the selected X-address line XL. The NAND gate circuit 400 in each pixel circuit PX drives the sampling transistor N1 in response to the select signals that are delivered to the two input terminals thereof. Thereby, the sampling transistor N1 samples the video signal voltage Vs output from the horizontal drive circuit HDRV to the video signal line 12 so that the sampled video signal voltage Vs can be held in the storage capacitance Cs and applied to the gate electrodes of the drive transistors N2 and N3.

In this liquid crystal display device, one of the pixel circuits PX can be random-accessed. Thus, with respect to only a pixel that requires a luminance variation in the already displayed one-frame image, the video signal voltage Vs can be refreshed. In this case, the liquid crystal display does not need to be supplied from outside with the video signal for other pixels that require no luminance variation. Hence, the transfer rate of the video signal can be reduced greatly. Therefore, the power consumption of the entire liquid crystal device can be reduced.

Further, the thin-film transistors in the above-mentioned embodiments may be formed using a single crystal semiconductor film which is obtained as a result of recrystllization of a non-single crystal semiconductor film effected by a laser crystallization apparatus. This laser crystallization apparatus may have a structure shown in FIG. 33. In this apparatus, an optical imaging system 139B is disposed between a phase shifter PS and a thin-film semiconductor substrate 114S to locate the phase shifter PS and thin-film semiconductor substrate 114S at the optically conjugated positions. That is, the thin-film semiconductor substrate 114S is set in a plane optically conjugated with the phase shifter PS (image plane of the optical imaging system 139B). An aperture diaphragm unit 139BA is disposed in an iris plane of the optical imaging system 139B. The aperture diaphragm unit 139BA includes a plurality of aperture diaphragms different from one another in the size of the aperture (light transmission portion), and these aperture diaphragms can be changed with respect to an optical path. Instead, the aperture diaphragm unit 139BA may be formed of an iris diaphragm with a continuously changeable aperture size. In any case, the size of the aperture of the aperture diaphragm unit 139BA (numerical aperture NA on the imaging side of the optical imaging system 139B) is set to obtain a required light intensity distribution of the inverse peak pattern on the semiconductor thin film 114 of the thin-film semiconductor substrate 114S. In addition, the optical imaging system 139B may be a refractive optical system, reflective optical system, or a refractive and reflective optical system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal pixel memory, comprising:

first and second power terminals;

first and second pixel electrodes that apply a liquid crystal drive voltage to a liquid crystal layer to create a substantially lateral electric field in the liquid crystal layer;

first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes; and a switch section that is driven to change voltages applied to the first and second power terminals such that a polarity of the liquid crystal drive voltage is cyclically reversed.

2. A liquid crystal pixel memory, comprising:

first and second power terminals;

first and second pixel electrodes that apply a liquid crystal drive voltage to a liquid crystal layer to create a substantially lateral electric field in the liquid crystal layer; and first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, wherein the first and second power terminals are connected to a power supply circuit that changes voltages applied to the first and second power terminals such that a polarity of the liquid crystal drive voltage is cyclically reversed.

3. The liquid crystal pixel memory according to claim 2, wherein the power supply circuit is configured to supply AC voltages, which are alternating between a first level and a second level, to the first and second power terminals with a phase difference of 180°.

4. A liquid crystal pixel memory, comprising:

first and second power terminals;

first and second pixel electrodes that apply a liquid crystal drive voltage to a liquid crystal layer to create a substantially lateral electric field in the liquid crystal layer;

first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes; and a capacitance element that is connected between the gate electrodes of the first and second drive transistors to retain the video signal.

5. A method of driving a liquid crystal pixel memory including first and second power terminals, first and second pixel electrodes that apply a liquid crystal drive voltage to a liquid crystal layer to create a substantially lateral electric field in the liquid crystal layer, and first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, the method comprising:

controlling the conductances of the first and second drive transistors by supplying the video signal to the gate electrodes of the first and second transistors; and changing voltages applied to the first and second power terminals such that a polarity of the liquid crystal drive voltage determined by the conductances is cyclically reversed.

6. The method of driving a liquid crystal pixel memory, according to claim 5, wherein a refresh cycle of the video signal is noncoincident with the cycle of reversal of the liquid crystal drive voltage.

7. The method of driving the liquid crystal display, according to claim 5, wherein the video signal is unipolar.

8. A liquid crystal display, comprising:

a pair of support substrates;

a liquid crystal layer that is held between the pair of support substrates; and a plurality of pixel circuits that are arrayed in a matrix on one of the support substrates and that control an alignment state of liquid crystal molecules, wherein each of the pixel circuits includes first and second power terminals, first and second pixel electrodes that apply a liquid crystal drive voltage to the liquid crystal layer to create a substantially lateral electric field in the liquid crystal layer, first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes; and a switch section that is driven to change voltages applied to the first and second power terminals such that a polarity of the liquid crystal drive voltage is cyclically reversed.

9. The liquid crystal display according to claim 8, wherein the video signal is unipolar.

10. A liquid crystal display, comprising:

a pair of support substrates;

a liquid crystal layer that is held between the pair of support substrates; and a plurality of pixel circuits that are arrayed in a matrix on one of the support substrates and that control an alignment state of liquid crystal molecules, wherein each of the pixel circuits includes first and second power terminals, first and second pixel electrodes that apply a liquid crystal drive voltage to the liquid crystal layer to create a substantially lateral electric field in the liquid crystal layer, first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, wherein the first and second power terminals are connected to a power supply circuit that changes voltages applied to the first and second power terminals such that a polarity of the liquid crystal drive voltage is cyclically reversed.

11. The liquid crystal display according to claim 10, wherein the one of the support substrates includes a plurality of scan lines that are arranged along rows of the pixel circuits and a plurality of video signal lines that are arranged along columns of the pixel circuits, and each of the pixel circuits is disposed in one of pixel areas that are defined by the scan lines and the video signal lines and includes a sampling transistor that has a gate electrode connected to an associated one of the scan lines and is connected between an associated one of the video signal lines and the gate electrodes of the first and second drive transistors.

12. The liquid crystal display according to claim 10, wherein the power supply circuit is provided integral with the support substrate.

13. The liquid crystal display according to claim 11, wherein each of the pixel circuits further includes a reflective electrode that overlaps parts of the first and second pixel electrodes via an insulation film and is set at a predetermined potential.

14. The liquid crystal display according to claim 11, wherein the first and second power terminals of each of the pixel circuits are formed of a pair of power lines interchanged relative to the pixel circuits in an adjacent row and in an adjacent column.

15. A method of driving a liquid crystal display which includes a pair of support substrates, a liquid crystal layer that is held between the pair of support substrates, and a plurality of pixel circuits that are arrayed in a matrix on one of the support substrates and that control an alignment state of liquid crystal molecules, wherein each of the pixel circuits includes first and second power terminals, first and second pixel electrodes that apply a liquid crystal drive voltage to the liquid crystal layer to create a substantially lateral electric field in the liquid crystal layer, and first and second drive transistors that have gate electrodes that receive a video signal, that are connected between the first power terminal and the first pixel electrode and between the second power terminal and the second pixel electrode, respectively, and that cause the liquid crystal drive voltage determined by conductances that vary in accordance with the video signal, to be retained in a liquid crystal capacitance between the first and second pixel electrodes, the method comprising:

controlling the conductances of the first and second drive transistors by supplying the video signal to the gate electrodes of the first and second transistors; and changing voltages applied to the first and second power terminals such that a polarity of the liquid crystal drive voltage determined by the conductances is cyclically reversed.

* * * * *